US005840459A

United States Patent [19]

Ohno et al.

[11] Patent Number: 5,840,459

[45] Date of Patent: Nov. 24, 1998

[54] TONER FOR DEVELOPING ELECTROSTATIC IMAGES AND PROCESS FOR PRODUCTION THEREOF

[75] Inventors: Manabu Ohno, Funabashi; Satoshi Mitsumura, Yokohama; Nobuyuki Okubo, Yokohama; Yoshinori Tsuji, Yokohama, all of Japan

[73] Assignee: Canon Kabushiki Kaisha, Tokyo, Japan

[21] Appl. No.: 662,081

[22] Filed: Jun. 12, 1996

[30] Foreign Application Priority Data

Jun. 15, 1995 [JP] Japan ..... 7-171614

[51] Int. Cl.[6] ..... G03G 9/08

[52] U.S. Cl. ..... 430/110; 430/109; 430/137

[58] Field of Search ..... 430/110, 109, 430/137

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,206,064 | 6/1980 | Kiuchi et al. | 430/106 |
| 4,404,271 | 9/1983 | Kawagishi et al. | 430/110 |
| 4,499,168 | 2/1985 | Mitsuhashi | 430/99 |
| 4,883,736 | 11/1989 | Hoffend et al. | 430/110 |
| 4,908,290 | 3/1990 | Watanabe et al. | 430/106.6 |
| 4,917,982 | 4/1990 | Tamono et al. | 430/99 |
| 4,921,771 | 5/1990 | Tamono et al. | 430/110 |
| 5,185,405 | 2/1993 | Nishida | 525/228 |
| 5,346,951 | 9/1994 | Suwada | 525/64 |
| 5,364,722 | 11/1994 | Tanikawa et al. | 430/110 |

FOREIGN PATENT DOCUMENTS

| | | | |
|---|---|---|---|
| 0531990 | 3/1993 | European Pat. Off. . | |
| 0627669 | 12/1994 | European Pat. Off. . | |
| 45-26478 | 9/1970 | Japan | 103/112 K |
| 52-3305 | 1/1977 | Japan . | |
| 55-42752 | 11/1980 | Japan . | |
| 56-16144 | 2/1981 | Japan . | |
| 57-168253 | 10/1982 | Japan . | |
| 58-215659 | 2/1983 | Japan . | |
| 58-41508 | 9/1983 | Japan . | |
| 59-7385 | 2/1984 | Japan . | |
| 60-198557 | 10/1985 | Japan . | |
| 60-217366 | 10/1985 | Japan . | |
| 60-252361 | 12/1985 | Japan . | |
| 60-252362 | 12/1985 | Japan . | |
| 62-9356 | 1/1987 | Japan . | |
| 63-127254 | 5/1988 | Japan . | |
| 1-309075 | 12/1989 | Japan . | |
| 2-235069 | 9/1990 | Japan . | |
| 3-72505 | 3/1991 | Japan . | |
| 4-97162 | 3/1992 | Japan . | |
| 5-80588 | 4/1993 | Japan . | |
| 52-3304 | 1/1997 | Japan . | |

OTHER PUBLICATIONS

Database WPI Week 8944, Derwent Publ. AN–89–318638 of JPA–01234858 (1989).

*Primary Examiner*—Marion E. McCamish
*Assistant Examiner*—Cheryl Juska
*Attorney, Agent, or Firm*—Fitzpatrick, Cella, Harper & Scinto

[57] ABSTRACT

A toner for developing electrostatic images, includes toner particles and 10–500 isolated low-molecular weight wax particles per 10,000 toner particles. The toner has a melt index as measured at 125° C. under a load of 98 N of at least 10. The toner particles comprise at least a binder resin, a colorant and the low-molecular weight wax. The low-molecular weight wax comprises a compound represented by the formula of: R—Y, wherein R denotes a hydrocarbon group, and Y denotes a hydroxyl group, carboxyl group, alkyl ether group or alkyl ester group. The low-molecular weight wax has a thermal property providing a DSC curve as measured by a differential scanning calorimeter exhibiting: (i) a maximum heat-absorption peak having a peak temperature in a temperature range of 70°–130° C.; (ii) a heat-absorption peak including the maximum heat-absorption peak showing an onset temperature of at least 50° C., and (iii) a maximum heat-evolution peak in a range of ±15° C. from the peak temperature of the maximum hat-absorption peak. The toner shows a good fixability while retaining a good productivity through the melt-kneading-pulverization process.

39 Claims, 10 Drawing Sheets

TONER FOR DEVELOPING ELECTROSTATIC IMAGES AND PROCESS FOR PRODUCTION THEREOF

FIELD OF THE INVENTION AND RELATED ART

The present invention relates to a toner for developing electrostatic images used in an image forming method, such as electrophotography and electrotatic printing, and a process for producing the toner; particularly a toner for developing electrostatic image adapted for a hot-pressure fixation scheme wherein a toner image formed of such a toner is fixed under application of heat and pressure onto a transfer (-receiving) material, such as paper, and a process for producing the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

In recent years, an image-forming apparatus performing an image forming method as described above not only is used as a business copier for simply reproducing an original but also has been used as a printer, typically a laser beam printer, for computer output and a personal copier for individual users.

In addition to such uses as representatively satisfied by a laser beam printer, the application of the basic image forming mechanism to a plain paper facsimile apparatus has been remarkably developed.

For such uses, the image forming apparatus has been required to be smaller in size and weight and satisfy higher speed, higher quality and higher reliability. Accordingly, the apparatus has been composed of simpler elements in various respects. As a result, the toner used therefor is required to show higher performances.

As for the step of fixing the toner image onto a sheet material such as paper which is the final step in the above process, various methods and apparatus have been developed, such as a heat and pressure fixation system using hot rollers, and a heat-fixing method where a transfer material carrying a toner image is pressed via a film against a heating member by a pressing member.

In the heat fixing system using a pressure roller or a film, a transfer material or fixation sheet carrying a toner image is passed while the toner image is caused to contact a hot roller or a film surfaced with a material showing a releasability against the toner to fix the toner onto the fixation sheet. In the fixing method, the toner image on the fixation sheet contacts the surface of the hot roller on the film, a very good heat efficiency is attained for melt-bonding the toner image onto the fixation sheet to allow a high-speed fixation, so that the method is very advantageous in a copying machine or a printer. In this method, however, as the toner image in a molten state contacts the hot fixing roller or film surface, a portion of the toner image is attached and transferred onto the fixing roller or film surface, and is re-transferred onto a subsequent fixation sheet (so-called offset phenomenon), thereby soiling the fixation sheet. In the heat-pressure fixing system, it is important to prevent the sticking of a toner onto the hot fixing roller or film surface.

In order to prevent a toner from sticking onto a fixing roller surface, it has been conventionally practiced to compose the fixing roller surface of a material showing excellent releasability against the toner, (e.g., silicone rubber or fluorine-containing resin) and further coating the surface with a film of a liquid showing a good releasability, such as silicone oil, so as to prevent the offset and deterioration of the fixing roller surface. This method is very effective for preventing offset but requires a device for supplying such an offset preventing liquid, thus resulting in complication of a fixing apparatus.

Further, this is contrary to the demand for a smaller and lighter apparatus and can sometimes soil the inside of the apparatus due to vaporization of the silicone oil, etc., by the application of heat. Therefore, based on a concept of supplying an offset-preventing liquid from inside toner particles under heating instead of using a device of supplying silicone oil, there has been proposed to incorporate a release agent, such as low-molecular weight polyethylene or low-molecular weight polypropylene. Addition of such a release agent in an amount exhibiting a sufficient effect is liable to lead to other practical problems, such as filming onto a photosensitive member, soiling of the surface of a carrier or a toner-carrying member, such as a sleeve, thus consequently resulting in deterioration of images. Accordingly, there has been adopted a combination of adding a release agent in an amount small enough to avoid image deterioration into toner particles and supplying a small amount of a release oil or using a cleaning device including a web used little by little to be wound for removing offset toner.

However, in view of the recent demand for a smaller and lighter apparatus yet satisfying a high reliability, even such an auxiliary device should desirably be removed. Accordingly, further improved fixability and anti-offset characteristic of toner are desired.

Based on a concept of providing a toner per se with good fixability and anti-offset characteristic, there have been hitherto proposed (1) to use a toner binder resin having two peaks in its molecular weight distribution, and (2) to add a low-molecular weight polyolefin polymer as represented by a low-molecular weight wax into a toner.

Examples of the proposal (1) may include those disclosed in JP-A 56-16144, JP-A 62-9356, JP-A 63-127254, JP-A 2-235069, JP-B 3-26831, and JP-A 3-72505. Examples of the proposal (2) may include those disclosed in JP-A 52-3304, JP-A 52-3305, JP-B 57-52574, JP-A 58-215659, JP-A 60-217366, JP-A 60-252361, JP-A 60-252362, JP-A 4-97162.

However, mere use of a binder resin having two peaks in the molecular weight distribution according to GPC or mere incorporation of a certain release agent in a toner may provide some improvements in fixability and anti-offset characteristic but can be accompanied with other difficulties, such as a lowering in dispersion of other components such as wax in the binder resin, leading to soiling of images, and melt-sticking or filming onto a photosensitive member, etc., in some cases.

Particularly, in case where a binder resin having two peaks in molecular weight distribution is provided with a broader molecular weight distribution by separating the molecular weights of the low-molecular weight component and the high-molecular weight component so as to further satisfy the requirements of a low-temperature fixability and anti-offset characteristic, the mutual solubility of both components is lowered so that, in addition to the above-difficulties, another difficulty is liable to be encountered in the toner production process. That is, as the pulverized particles are liable to be accompanied with a mechanical strength irregularity therein, particle portions rich in localized low-molecular weight component having an inferior mechanical strength are subjected to fine pulverization within individual toner particle production steps, and within conduit pipes for powder transportation connecting the steps, thus resulting in finer powder to promote the attachment and melt-sticking of the toner.

In case where the kneading condition in the melt-kneading step for toner production is enhanced in order to improve the mutual dissolution and dispersion of the toner components, the molecular chains of the binder resin are severed to remarkably lower the molecular weight of the binder resin, thus being liable to lower the anti-offset characteristic, particularly the high temperature-side anti-offset characteristic.

In case where a large amount of wax is added in order to exhibit sufficient anti-offset characteristic, several difficulties are liable to be encountered, such as inferior anti-blocking characteristic, a lowering in wax dispersibility, promoted soiling of the surfaces of the carrier and developing sleeve, leading to image quality deterioration.

On the other hand, it has been also proposed to effect dry blending of wax with a toner by a mixer. For example, JP-A 57-168253 has proposed a dry-process heat-fixable toner obtained by adding 0.2–1 wt. part of low-molecular weight polypropylene to 100 wt. parts of an ordinary toner, and JP-A 1-309075 has proposed an electrophotographic toner obtained by adding release agent particles onto particles formed from toner components except for a release agent.

The above toners have advantages of attaining a quick effect and reducing the addition amount of a wax, such as low-molecular weight polypropylene to the toner particle surface. However, it is generally difficult to pulverize a wax into fine particles and, even if such fine pulverized wax particles are obtained, the wax particles are liable to cause mutual agglomeration, thus resulting in lower flowability and storability of the resultant toner.

Wax fine particles obtained by pulverization are indefinite-shaped particles having a large number of pulverization surfaces and are therefore weak in mechanism strength, so that they are liable to soil the stirring device and the developing sleeve in the developing device.

JP-A 60-198557 has proposed a magnetic toner containing at most 0.02 wt. % of wax particles having a particle size of at least 0.1 $\mu$m.

In this case, it is possible to suppress the adverse effect to the toner flowability and storability. As described above, however, it is generally difficult to uniformly attach wax fine particles to individual toner particles by dry blending. This difficulty is more pronounced at a smaller amount of addition of wax fine powder and a higher agglomeratability of wax fine powder. The application of a higher shearing force during the stirring aiming at uniform blending is rather liable to result in an adverse effect to the toner (i.e., pulverization of toner).

As a representative toner production process, there has been known a melt-kneading-pulverization process wherein a binder resin, a release agent, a colorant, such as magnetic material particles, dye or pigment, a charge control agent, etc., are formulated, preliminarily blended and melt-kneaded for dispersion, followed by coarse pulverization, fine pulverization and classification to obtain toner particles.

In the meltkneading-pulverization process, the pipes within powder processing steps, such as kneading, pulverization, deintegration, classification, blending and sieving, and the pipes for powder transportation between the steps, are appropriately designed with respect to toner powder density and flow speed and pipe inner diameters based on calculation according to chemical engineering and also in consideration of powder transportation efficiency, pressure through the pipes and auxiliary facilities.

However, in the case of production of a sticky toner or a toner containing a low-melting point toner showing a large melt-index for providing a low-temperature fixability, the toner is liable to cause melt-sticking or solidification at bent parts, such as an injection feeder and bent and elbows in the pipes. Such difficulty is particularly pronounced in case where the binder resin is provided with a broader molecular weight distribution having further separated peaks.

At present, the production apparatus and pipes are generally cleaned by (1) disintegrating the apparatus and cleaning the resultant members by air blowing, wiping with water or solvent, or brushing, and (2) co-washing by using another grade toner as a dummy. However, the cleaning according to the method (1) takes a lot of time and affects the operation rate to result in a lower production efficiency. The method (2) is effective at the time of changing product toner grades, but is accompanied with a lower cleaning effect, wasting of materials and lowering in production capacity of the apparatus compared with the method (1).

In contrast thereto, JP-A 5-80588 has proposed a process for toner production using pipes within toner production steps and for powder transportation between the steps having smoothened inner surfaces as formed by polishing or resin coating and performing powder transportation at an air flowing speed of at most 30 m/sec.

The above method is effective for a relatively sticky toner, such as a color toner, but requires a high initial cost for smoothening the pipe inner surfaces and for newly providing an anti-powder explosion treatment. Further, as the air flow speed has to be kept low, it is difficult to improve the productivity. Further, if the above process is used for producing a magnetic toner, the smoothened surfaces are abraded and deteriorated due to abrasive characteristic of the magenta toner, so that the toner melt-sticking and solidification are again liable to be caused.

Various performances required of a toner are mutually contradictory in many cases and are desired to be satisfied together to high degrees in recent years. Thus, an overall study is now required also in consideration of toner productivity in addition to toner performances, such as fixability, anti-offset characteristic, developing performance and storage stability.

SUMMARY OF THE INVENTION

A generic object of the present invention is to provide a process for producing a toner for developing electrostatic images having solved the above-mentioned problems and a process for production of such a toner.

A more specific object of the present invention is to provide a toner for developing electrostatic images having excellent low-temperature fixability and anti-offset characteristic and correspondingly a broad fixable temperature range, and a process for production of such a toner.

Another object of the present invention is to provide a toner for developing electrostatic images having an excellent anti-blocking characteristic and a developing characteristic free from deterioration, and a process for production of such a toner.

Another object of the present invention is to provide a toner for developing electrostatic images capable of realizing high-quality images and not adversely affecting a photosensitive member or a developer-carrying member, and a process for producing such a toner.

A further object of the present invention is to provide a toner production process wherein toner production steps and pipes for powder transportation between the steps are less liable to suffer from toner attachment or melt sticking and which can be maintenance-free for a long period to provide an improved production efficiency.

According to the present invention, there is provided a toner for developing electrostatic images, comprising:

toner particles and low-molecular weight wax particles;

wherein the toner has a melt index as measured at 125° C. under a load of 98 N of at least 10, the toner particles comprise at least a binder resin, a colorant and a low-molecular weight wax, the wax particles are present at a rate of 10–500 particles per 10,000 toner particles, the low-molecular weight wax comprises a compound represented by the formula of: R-Y, wherein R denotes a hydrocarbon group, and Y denotes a hydroxyl group, carboxyl group, alkyl ether group or alkyl ester group; and the low-molecular weight wax has a thermal property providing a DSC curve as measured by a differential scanning calorimeter exhibiting:

(i) a maximum heat-absorption peak on temperature increase having a peak temperature in a temperature range of 70°–130° C.;

(ii) a heat-absorption peak including the maximum heat-absorption peak showing an onset temperature of at least 50°0 C., and (iii) a maximum heat-evolution peak on temperature decrease in a range of ±15° C. from the peak temperature of the maximum hat-absorption peak.

According to another aspect of the present invention, there is provided a process for producing a toner as described above, comprising:

a preliminary blending step of blending a feed material of a toner composition including at least a binder resin, a colorant and a low-molecular weight wax by means of a blender to prepare a blend, a melt-kneading step of melt-kneading the blend by a kneading means to form a kneaded product, a pulverization step of pulverizing the kneaded product after cooling by a pulverizing means after cooling to form a pulverizate; and a classification step of classifying the pulverizate by a classifying means to recover a toner, wherein the classification step includes a powder transporting step using an air injection feeder.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
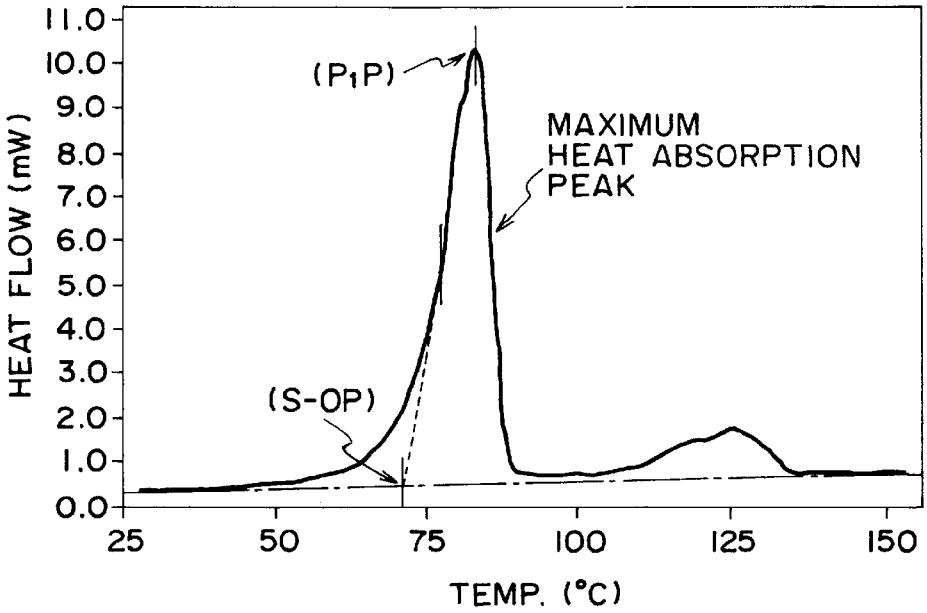
FIGS. 1 and 2 show DSC curves on temperature increase and temperature decrease, respectively, of a low-molecular weight wax with some denotation therein.

As a result of our extensive study, it has been found possible to provide a toner having a very broad fixable temperature range, exhibiting excellent storage stability and dot reproducibility and capable of stably providing good toner images free from fog for a long period by incorporating a low-molecular weight wax having specific thermal properties in toner particles and allowing the low-molecular weight wax to be co-present in a specific particulate form isolated out of the toner particles. It has been also found that the toner can be produced through the meltkneading-pulverization process while avoiding the attachment and melt-sticking of toner in the apparatus used in the toner production steps, including injection feeders, and pipes for powder transportation connecting the production steps.

The toner according to the present invention contains as an essential component a specific low-molecular weight wax characterized a thermal property as represented by a DSC curve as measured by a differential scanning calorimeter (DSC) showing a maximum heat-absorption peak on temperature increase (i.e., in the course of heating) in a temperature range of 70°–130° C., a maximum heat-evolution peak on temperature decrease (i.e., in the course of cooling) in a range of ±15° C. from the maximum heat-absorption peak temperature, and a heat-absorption peak including the maximum heat-absorption peak showing an onset temperature of at least 50° C. The toner may preferably be prepared by controlling the kneading conditions and cooling speed of the kneaded product. More specifically, a blend or mixture including the low-molecular weight wax together with the binder resin is melt-kneaded at a temperature providing a melt-viscosity in the range of $10^2$–$10^6$ poises and then cooled at a rate of 1°–20° C./sec to be solidified, followed by pulverization. As a result, a relatively soft toner having a melt index of at least 10 and including partially isolated particles of the low-molecular weight wax at a dispersion rate of 10–500 particles per 10,000 toner particles.

In order to provide a toner with a fixability from a lower temperature region, the toner composition has to be softened or become fluid from a lower temperature.

In the present invention, the binder resin is well plasticized without impairing the storage stability to provide a soft toner having a melt index of at least 10 by using the above-mentioned low-molecular weight wax providing a DSC curve exhibiting a maximum heat-absorption peak on temperature increase in a range of 70°–130° C. and a heat-absorption peak including the maximum heat-absorption peak and showing an initial onset temperature of at least 50. As a result, the partial isolation state of the low-molecular weight wax can be controlled in a preferable manner to provide in combination a good low-temperature fixability of toner and a good toner productivity according to the meltkneading-pulverization process.

If the maximum heat-absorption peak is at below 70° C. or at above 130° C., a sufficient combination of low-temperature fixability and anti-offset characteristic cannot be attained, and the isolation state of the isolated wax becomes inappropriate. Below 70° C., as the low-molecular weight wax is finely dispersed in the binder resin, it becomes difficult to obtain isolated wax particles, so that the formation of a wax film in the production apparatus including the injection feeder and transportation pipes becomes insufficient. Above 130° C., the mutual solubility of the low-molecular weight wax within the binder resin is lowered and the binding strength is enhanced, so that the control of the isolation state of the low-molecular weight wax becomes difficult and the toner chargeability is adversely affected. Further, the matching or compatibility with an image forming apparatus having a photosensitive drum can be difficult.

As the initial or starting onset temperature of the heat-absorption peak including the maximum heat-absorption peak is set to be at least 50° C., the plasticization of the binder resin can be moderately controlled, so that the anti-blocking property is ensured without impairing the low-temperature fixability, and overpulverization due to an insufficient toner strength can be prevented, thus providing an improved toner production efficiency.

On the other hand, on the DSC curve on temperature decrease, there is observed a heat-evolution peak due to the solidification and re-crystallization of the low-molecular weight wax. The phenomenon that the heat-evolution peak occurs in the vicinity of the maximum heat-absorption peak on temperature increase indicates that the low-molecular weight wax is uniform. By decreasing the peak temperature difference, the heat responsiveness of the low-molecular weight wax becomes quick and an excessive plasticizing effect can be suppressed. Accordingly, the low-molecular weight wax used in the present invention is one providing a maximum heat-evolution peak on temperature decrease at a temperature within a range of ±15° C. from the maximum heater-absorption peak temperature on temperature increase. The temperature difference range may preferably be ±9° C., particularly preferably ±5° C. As a result, when the toner containing the low-molecular weight wax is heated in the fixing device, the binder resin can be instantaneously plasticized, thus remarkably contributing to an improved low-temperature fixability and effectively exhibiting the releasability of the wax, so that the low-temperature fixability and anti-offset characteristic are satisfied in combination at a high degree. The wax fine particles formed by partial isolation of the low-molecular weight wax forms a wax film on the inner walls of the production apparatus including the injection feeder and transportation pipes, thereby well preventing the melt-sticking and solidification of the toner. Further, by dispersing the low-molecular weight wax within the binder resin and also in the form of wax particles co-present with the toner particles due to partial isolation of the wax, the melt-sticking of toner onto the developing sleeve or photosensitive drum may be suppressed, without adversely affecting the toner chargeability.

In the DSC measurement used for characterizing a wax, a heat exchange with the wax is measured to observe the thermal behavior. In view of such a measurement principle, the DSC measurement may preferably be performed by using an internal heating input compensation-type differential scanning calorimeter which shows a high accuracy based on the measurement principle. A commercially available example thereof is "DSC-7" (trade name) mfd. by Perkin-Elmer Corp.

The measurement may be performed according to ASTM D3418-82. Before a DSC curve is taken, a sample (wax) is once heated and cooled for removing its thermal history and then subjected to heating (temperature increase) at a rate of 10° C./min. in a prescribed temperature range for taking DSC curves. The temperatures or parameters characterizing the invention are defined as follows. Absorbed heat is taken in the positive (or upward) direction. Specific examples of such temperatures or parameters are shown in FIGS. 1 and 2.

Maximum heat-absorption peak temperature is a peak-top temperature of a maximum heat-absorption peak in a temperature range of 30°–200° C. on a DSC curve obtained on temperature increase (corresponding to $P_1P$ in FIG. 1).

Onset temperature of a heat-absorption peak is a temperature at which the tangential line taken at a point giving a first maximum of differential (slope) of a heat-absorption peak on a DSC curve on temperature increase intersects the base line (corresponding to S-OP in FIG. 1).

Figure 2:
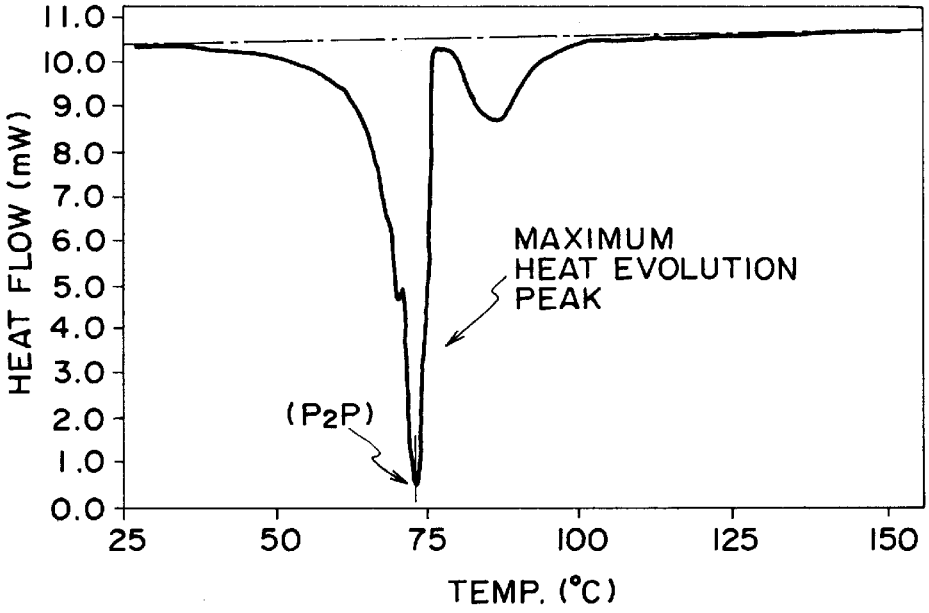

Maximum heat-evolution peak temperature is a peak-top temperature of a maximum heat-evolution peak on a DSC curve on temperature decrease (corresponding to $P_2P$ in FIG. 2).

Melt index

The melt index values referred to herein are based on values measured according to JIS K7210-1976 (Japanese Industrial Standards; Flow Test for Thermoplastics) by using a specified apparatus under the following condition according to a manual cutting method. The measured amount is converted into an amount of a sample toner extruded within 10 min.

Temperature: 125° C.

Load: 98 N (10 kg-f)

Packed sample weight: 5–10 g.

Particle of a soft toner composition showing a melt index of 10 or larger are generally liable to cause the melt-sticking or solidification when pneumatically transported at a high speed within the production steps, through pipes between the steps and in the injection feeder, thus making it difficult to continue the production for a long period. However, in the toner production process according to the present invention wherein a wax comprising a compound having a specific functional group is used, and a specific amount of isolated particles of the wax are co-present with the powdery toner composition, the melt-sticking or solidification of the powder in the apparatus or connecting pipes is prevented or suppressed to allow a continuous toner production for a long period.

During transportation or movement within the toner production steps and through transporting pipes, the movement within the apparatus or pipes of the powdery toner composition is affected by a transporting air speed distribution so that the transportation speed thereof is slower in proximity to the wall. As a result, in proximity to the wall where the transportation speed is slower, a fine powder fraction of the powdery toner composition having a smaller particle size, a smaller weight and a large attachment force is present at a higher percentage, so that the fine powder fraction is liable to cause melt-sticking or solidification. Particularly, in the case of a soft toner composition having a large melt index, the melt-sticking or solidification of the powder thereof is promoted remarkably when the transportation speed and the powder concentration of the powdery toner composition are increased. In the process of the present invention, however, the inner walls of the apparatus and the pipes are coated with a film of the wax particles having a functional group, so that the melt-sticking or solidification of the powder toner composition can be obviated or suppressed. Particularly, when the low-molecular weight wax comprising a functional compound having the above-mentioned thermal properties is used and a high-speed powder transportation is performed at an air speed of at least 35 m/sec by using an injection feeder, a good balance is given between the coating film formation speed and the abrasion speed, so that a uniform coating state can be retained for a long period. As a result, the maintenance operation of the toner production facilities becomes almost unnecessary, and a soft toner allowing low-temperature fixation can be produced at a high productivity.

In the present invention, the above-mentioned effects are achieved by using particles (toner particles) of a soft toner composition comprising at least a binder resin, a colorant and a low-molecular weight wax comprising a compound having a functional group, and wax particles formed by isolation of the low-molecular weight wax co-present at a rate of 10–500 particles, preferably 10–100 particles, per 10,000 toner particles. When less than 10 wax particles are co-present per 10,000 toner particles, the coating layer or film formation with the wax particles on the walls of the apparatus within the production steps and the connecting pipes becomes insufficient, so that a sufficient effect of preventing the melt-sticking or solidification of the powdery toner composition becomes difficult to obtain. On the other hand, when more than 500 wax particles are present per 10,000 toner particles, the flowability and storage stability of the resultant toner are lowered, and the chargeability of the toner is adversely affected, so that image defects, such as a lowering in image density and image fog, are liable to result.

Number of wax particles

Herein, the number of wax particles formed by partial isolation of the low-molecular weight wax having a functional group relative to the number of toner particles may be measured by observation through an optical microscope by counting the number of wax particles having a longer-axis diameter of at least 0.5 $\mu$m relative to the number of toner particles having a diameter of at least 2 $\mu$m. More specifically, a sample toner is first dispersed at a rate of ca. 0.2 g/ml in a dispersion medium, such as silicone oil or liquid paraffin, and ca. 0.02 ml of the dispersion liquid is spread to an area of ca. 20 mm×40 mm on a slide glass. At this time, the toner is sufficiently dispersed so that individual particles (toner particles and wax particles) are separated from each other. This state is photographed (at a magnification of 200) for counting the number of the respective particles or analyzed by an image analyzer (e.g., "Luzex III", available from K.K. Nireco) so as to count the number of the respective toner particles displayed on a screen at a magnification of 200. Further, the same state (of the same visual field at the same magnification of 200) is photographed through a polarizer. At this, the wax particles are observed as white bright spots in a dark field because of the crystallinity, and the number of the bright spots is counted similarly as in the counting of toner particles. The above operation is repeated several times to measure the number of wax particles per 10,000 toner particles.

The wax particles are formed at the time of fine pulverization after melt-kneading of the toner composition under the prescribed conditions and cooling for solidification, and the shape thereof is almost spherical. As a result, the lowering in flowability and chargeability of the resultant toner is prevented.

The low-molecular weight wax may preferably have a weight-average molecular weight (Mw) of at most $3\times10^4$, more preferably at most $1\times10^4$. It is further preferred that the wax has an Mw of 400–3,000, a number-average molecular weight (Mn) of 200–2,000, and a ratio Mw/Mn of at most 3.0.

If Mw of the wax is below 400, the toner is liable to be excessively sensitive to thermal influence and mechanical influence and to have inferior anti-offset characteristic and storage stability. If Mw of the wax exceeds 3,000, particularly $3\times10^4$, the toner is liable to have inferior low-temperature fixability and anti-low-temperature-offset characteristic.

The low-molecular weight wax may preferably be contained in a proportion of 1–20 wt. parts, more preferably 2–15 wt. parts, per 100 wt. parts of the binder resin in the toner particles or toner composition.

The low-molecular weight wax comprises a compound represented by the above-mentioned formula R-Y. As a result, the uniform dispersion of the low-molecular weight wax in the binder resin is promoted, and the formation of the coating layer having a releasability on the inner walls of the apparatus and the connecting pipes are promoted. The compound may preferably be a long-chain alkyl compound having a functional group represented by the formula R'-Y, wherein R' denotes a long-chain alkyl group having 20–202 carbon atoms, and Y denotes a hydroxyl group, carboxyl group, alkyl ether group or alkyl ester group each having 2–200 carbon atoms.

It is preferred that at least 60 wt. %, preferably at least 70 wt. % of the low-molecular weight wax is occupied by the compound represented by the formula R'-Y so as to accomplish the object of the present invention at a high degree. It is further preferred that the compound of the formula R-Y or R'-Y constitutes 60–95 wt. %, more preferably 70–90 wt. % of the low-molecular weight wax in combination another wax compound described later.

Specific examples of the compound represented by the formula R'-Y may include those represented by the following formula:

(A) $CH_3(CH_2)_nCH_2OH$ (B) $CH_3(CH_2)_nCH_2COOH$ (C) $CH_3(CH_2)_nCH_2OCH_2(CH_2)_mCH_3$ (D) $CH_3(CH_2)_nCH_2COO(CH_2)_mCH_3$.

In the above, n=20–200, and m=0–100.

The long-chain alkyl compound represented by the formula R'-Y, may preferably comprise a combination or mixture of compounds having different numbers of carton atoms. It is further preferred to use a combination of compounds including compounds having at least 25, preferably at least 35, more preferably at least 45, carbon atoms based on a carbon number distribution according to gas chromatography as a principal constituent.

It is particularly preferred to use a low-molecular weight wax containing at least 60 wt. %, preferably at least 70 wt. %, of a long-chain alkyl alcohol of the formula $CH_3(CH_2)_nCH_2OH$ (n=20–200), or at least 60 wt. %, preferably at least 70 wt. %, of a long-chain alkyl carboxylic acid of the formula $CH_3(CH_2)_nCH_2COOH$ (n=20–200).

Examples of another wax component which may be used in combination with the compound represented by the formula R-Y may include: paraffin waxes and derivatives thereof, Fischer-Tropsch wax and derivatives thereof, and polyolefin waxes and derivatives thereof. Examples of the derivatives may include block copolymers or grafted products with vinyl monomers.

Preferred examples of the wax component may include low-molecular weight alkylene polymers obtained through polymerization of an alkylene by radical polymerization under a high pressure or in the presence of a Ziegler catalyst and by-products thereof; low-molecular weight alkylene polymers obtained by thermal decomposition of an alkylene polymer of a high molecular weight; distillation residue of hydrocarbons synthesized from a mixture gas of carbon monoxide; and synthetic hydrocarbons obtained by hydrogen addition of the above.

It is further preferred to use a polymer of an alkylene, such as ethylene, polymerized in the presence of a Ziegler catalyst and a by-product thereof; and polymethylene wax, such as Fischer Tropsch wax, principally comprising long-chain hydrocarbon compounds having up to several thousand carbon atoms, particularly up to ca. 1,000 carbon atoms.

It is also preferred to use a fractionated wax component obtained by fractionation according to molecular weights of the above wax material, e.g., by the press sweating method, the solvent method, vacuum distillation, supercritical gas extraction method or fractional crystallization (e.g., fusion crystallization or crystal filtration). Fractionated products can be subjected to block copolymerization or graft-modification.

The wax used in combination with the long-chain alkyl alcohol or long-chain alkyl carboxylic acid may preferably be polymethylene wax, polyethylene wax or polypropylene wax. Polyethylene wax is particularly preferred.

In case of using different waxes in combination, the waxes may preferably be combined so as to satisfy the following formulae (A) and (B) so as to provide good low-temperature fixability, anti-offset characteristic and anti-blocking property, and also an improved developing performance.

$$70 \leqq (P_1Pl+P_1Ph)/2 \leqq 130 \quad (A)$$

$$P_1Ph-P_1Pl \leqq 80 \quad (B),$$

wherein $P_1Ph$ and $P_1Pl$ denote maximum heat-absorption peak temperatures of a higher melting-point wax and a lower melting-point wax, respectively, measured by using a differential scanning calorimeter (DSC).

The formula (A) specifies a range of an average of melting points of the two waxes. If the average is below 70° C., the low-temperature fixability may be good, but the anti-offset characteristic and anti-blocking property can be remarkably impaired. If the average exceeds 120° C., the low-temperature fixability is impaired.

The formula (B) defines a maximum melting point difference between the two waxes. If the difference exceeds 80° C., the control of wax dispersion state becomes difficult, and the matching between the developing performance and the image forming apparatus becomes difficult.

Wax molecular weight distribution

The molecular weight distribution of a wax may be measured by gel permeation chromatography (GPC) according to the following conditions.

The molecular weight (distribution) of a long-chain alkyl compound may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a sample at a concentration of 0.15 wt. %.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

Carbon number distribution

The distribution of carbon number (number of carbon atoms) of a wax may be measured by gel permeation chromatography according to the following conditions.

Apparatus: "HP 5890 Series II" (available from Yokogawa Denki K.K.)

Column: SGE HT-5, 6 m×0.53 m MID×0.15 μm

Carrier gas: He 20 m/min, Constant Flow Mode

Oven temperature: From 40° C. to 450° C.

Inlet temperature: From 40° C. to 450° C.

Detector temperature: 450° C.

Detector: FID

Inlet: With pressure controller

The measurement may be performed under the above conditions while placing the inlet (injection port) under a pressure control and keeping an optimum flow rate at constant.

The binder resin used in the present invention may be known ones. Among these, a polyester resin and a vinyl resin are preferred.

A polyester resin preferably used in the present invention may have a composition such that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol. A, bisphenols and derivatives represented by the following formula (I):

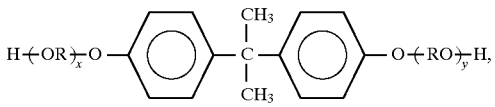

(I)

wherein R denotes an ethylene or propylene group, x and y are independently a positive number of at least 1 with the proviso that the average of x+y is in the range of 2–10; and diols represented by the following formula (II):

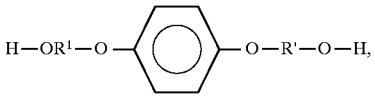

(II)

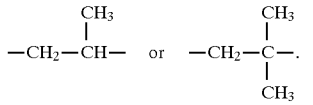

wherein R' denotes —$CH_2CH_2$—,

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$ –$C_8$ alkyl-substituted succinic acids, and their anhydrides; and unsaturated dicarboxylic acids, such as fumaric acid, maleic acid, citraconic acid and itaconic acid, and their anhydrides.

It is also possible to add a polyvalent alcohol, such as glycerin, pentaerythritol, sorbit, sorbitan, or oxyalkylene ether of, e.g. novolak-type phenolic resin; or a polybasic carboxylic acid, such as trimellitic acid, pyromellitic acid, or benzophenonetetracarboxylic acid or anhydride thereof, as a crosslinking component.

An especially preferred class of alcohol components constituting the polyester resin is a bisphenol derivative represented by the above formula (I), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride. Preferred examples of the crosslinking component may include trimellitic anhydride, benzophenonetetracarboxylic acid, pentaerythritol and oxyalkylene ether of novolak-type phenolic resin.

Examples of a vinyl monomer for providing the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of α,β-unsaturated acids and diesters of dibasic acids.

Examples of a carboxy group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid. alkenyladipic acid, and anhydrides and monoesters of these acids.

It is also possible to use a hydroxyl group-containing vinyl monomer: inclusive of acrylic or methacrylic acid esters, such as 2-hydroxyethyl acrylate, and 2-hydroxyethyl methacrylate; 4-(1-hydroxy-1-methylbutyl)styrene, and 4-(1-hydroxy-1-methvlhexyl) styrene.

The binder resin component may preferably have a molecular weight distribution based on a GPC chromatogram (obtained with respect to its THF-soluble content) showing a main peak in a molecular weight region of 2,000–30,000 and a sub-peak or shoulder in a molecular weight region in excess of $10^5$.

In case where the binder resin fails to provide a GPC molecular weight distribution showing a sub-peak or shoulder in a molecular weight region in excess of $10^5$, the resultant toner is liable to have an inferior anti-high temperature-offset characteristic, and the uniform dispersion of other additives, such as a colorant or a charge control agent, may become difficult, thus being liable to result in a lower image density or image defects. If the main peak molecular weight of the binder resin is below 2,000, the plasticization by the above-mentioned low-molecular weight becomes intense, so that the resultant toner is caused to have a lower triboelectric chargeability, and also inferior anti-high temperature offset characteristic and storage stability. Further, the strength of toner particles is lowered, so that the matching with the image forming apparatus becomes difficult and, when the toner particles are produced through the pulverization process, overpulverization is liable to be caused to result in a lot of fine toner powder and a lowering in productivity. On the other hand, if the main peak molecular weiaht exceeds 30,000, the developing performance of the toner is improved and the overpulverization is prevented, but the low-temperature fixability is lowered. Further, as the medium molecular weiaht fraction is increased, the toner pulverization efficiency during toner production is lowered.

Further, based on the above-mentioned GPC molecular weight distribution, the binder resin component may preferably have a ratio Mw/Mn of at least 20 between weight-average molecular weight (Mw) and number-average molecular weight (Mn), contain a low-molecular weight fraction having a molecular weight of at most 1,000 providing an areal ratio of at most 15%, and contain a high-molecular weight fraction having a molecular weight of at least $10^6$ providing an areal ratio of 0.5–25%.

By controlling the GPC molecular weight distribution of the binder resin component, a good combination effect with the low-molecular weiaht wax comprising a compound represented by the formula R-Y can be attained. More specifically, an Mw/Mn ratio of at least 20 allows to enjoy a plasticizing effect of the low-molecular weight wax. Further, the dispersibility of the low-molecular weight wax is improved to allow the desirable partial isolation state. On the other hand, if the low-molecular weight fraction (≦1000) exceeds an areal percentage of 15%, the above-mentioned problems accompanying the over-plasticization become more pronounced. Further, the toner becomes liable to cause melt-sticking onto the photosensitive drum and less compatible with the image forming apparatus. Further, it becomes difficult to control the degree of partial isolation of the low-molecular weight wax in a preferable range. If the areal percentage of the high-molecular weight fraction (≦$10^6$) is below 0.5%, the control of the partial isolation state of the low-molecular weight wax becomes difficult, and the resultant toner is liable to be deteriorated due to an external force given by the image forming apparatus. As a result, the developing performance and durability of the toner are impaired, thus being liable to cause remarkable image fog in a low temperature-low humidity environment and lowering in image density in a high temperature—high humidity environment. On the other hand, if the high molecular weight fraction is present in excess of 25%, the low temperature fixability and the toner productivity are impaired, and the uniform dispersion of the toner constituents becomes difficult, thus failing to provide a uniform toner chargeability and resulting in a lower developing performance.

The above-mentioned problems generally become pronounced in case of a small particle size toner or a magnetic toner requiring uniform dispersion of high-density magnetic fine particles. However, these problems can be alleviated, and it becomes easier to take balances among the performances required of a toner, by controlling the GPC molecular weight distribution within the above-described range.

GPC molecular weight measurement for resin

The molecular weight distribution of a toner or a toner binder resin may be measured with respect to its THF (tetrahydrofuran)-soluble content under the following conditions:

Apparatus: GPC-150C (available from Waters Co.)

Columns: 7 columns of KF801–KF807 (all available from Showdex K.K.)

Temperature: 40° C.

Solvent: THF (tetrahydrofuran)

Flow rate: 1.0 ml/min.

Sample concentration: 0.05–0.6 wt. %

Sample volume: 0.1 ml

A GPC sample may be prepared in the following manner.

A sample resin or toner is placed in THF, left standing for several hours and then sufficiently stirred for mixing with THF until the coalescence of the sample is removed. Then, the resultant liquid mixture is passed through a sample-treating filter having a pore size of 0.45–0.5 μm (e.g., "Maishori Disk H-25-5", available from Toso K.K.; "Ekikuro Disk 25CR", available from German Science Japan K.K.) to provide a GPC sample having a resin concentration as described above.

The molecular levels (on the abscissa) of a resultant GPC chromatogram may be determined based on a calibration curve prepared by using monodisperse polystyrene standard samples.

The resin component or composition constituting the toner according to the present invention may preferably be substantially free from THF-insoluble content. More specifically, it is preferred that the resin composition does not contain more than 5 wt. %, preferably more than 3 wt. %, of a THF-insoluble content.

The "THF-insoluble content" referred to herein means a polymer component (substantially, a crosslinked polymer) which is insoluble in a solvent THF (tetrahydrofuran) within the resin composition constituting a toner, and thus may be used as a parameter indicating the degree of crosslinking of a resin composition containing a crosslinked component. The THF-insoluble content may be defined as a value measured in the following manner.

About 0.5–1.0 g of a toner sample or a resin composition sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor. The extraction is performed for 6 hours. The soluble content extracted with the solvent is dried first by evaporation of the solvent and then by vacuum drying at 100° C. for several hours, and weighed (at $W_2$ g). The components other than the resin component, such as a magnetic material and pigment, are weighed or determined (at $W_3$ g). The THF-insoluble content (wt. %) is calculated as $[(W_1-(W_3+W_2))/(W_1-W_3)]\times 100$.

A THF-insoluble content exceeding 5 wt. % causes a lowering in low-temperature fixability and also lowers the pulverization efficiency during toner production to result in a lower productivity.

The binder resin used in the present invention may preferably be provided as a mixture of a low molecular weight polymer component and a high-molecular weight polymer component, preferably in a weight ratio of 30:70–90:10, particularly 50:50–85:15 in case where prepared by solution blending. If the high-molecular weight component is more than the above described range, the fixability of the resultant toner is lowered. Further, the viscosity at the time of solution blending is increased, whereby the mutual solubility and dispersibility of the resin components are impaired, and the severance of molecular chains of the binder resin is incurred. Further, if such binder resin is melt-kneaded with other toner components, the dispersion failure or localization of the toner components is liable to be caused. On the other hand, if the high-molecular component is less than the above range, the resultant toner is caused to have a lower anti-high temperature offset characteristic and a lower developing performance.

The binder resin, and the low-molecular weight polymer component and high-molecular weight polymer component thereof, may respectively be adjusted to have a glass transition temperature (Tg) in a range of 50°–70° C. If Tg is below 50° C., the resultant toner is liable to be degraded in a high temperature environment and is liable to cause offset at the time of heat fixation.

Tg of resin

Measurement of Tg of a resin may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed. The sample is placed on an aluminum pan and subjected to measurement in a temperature range of 30°–200° C. at a temperature-raising rate of 10° C./min in a normal temperature-normal humidity environment in parallel with a blank aluminum pan as a reference. In the course of temperature increase, a main absorption peak appears in the temperature region of 40°–100° C. In this instance, the glass transition temperature (Tg) is determined as a temperature of an intersection between a DSC curve and an intermediate line passing between the base lines obtained before and after the appearance of the absorption peak.

The binder resin used in the present invention may be obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step or in situ polymerization process wherein one of the low-molecular weight polymer component and the high-molecular weight polymer component is once prepared, e.g., by a known polymerization and is dissolved in a monomer constituting the other polymer component, and the resultant solution is subjected to polymerization, to prepare a binder resin.

As a preferred embodiment, the toner according to the present invention can be constituted as a magnetic toner containing a fine powdery magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The fine powdery magnetic material may preferably have a BET specific surface area of 4–40 $m^2/g$, more preferably 4–15 $m^2/g$. By specifying the BET specific surface area of the magnetic material in the above-described range, it is possible to preferably adjust the chargeability and productivity of the toner. If the BET specific surface area of the magnetic material exceeds 40 $m^2/g$, the moisture absorptivity is increased to adversely affect the moisture absorptivity and chargeability of the toner, and the abrasion of the releasable coating layer of the wax particles formed on the inner walls of the production apparatus and the transportation pipes is promoted to cause the melt-stickina and solidification of the toner. Below 4 $m^2/g$, the resultant toner is liable to cause a charge-up phenomenon in a low humidity environment.

The BET specific surface area may be measured according to the BET multi-point method by using an automatic gas absorption measurement apparatus (e.g., "Autosorb 1", available from Yuasa Ionix K.K.) and nitrogen as the adsorbate gas. The sample is pre-treated by evacuation at 50° C. for 10 hours.

The fine powdery magnetic material may have an average particle size (Dav.) of 0.02–2 $\mu$m, preferably 0.1–0.5 $\mu$m. The magnetic material may preferably show magnetic properties when measured by application of 10 kilo-Oersted, inclusive of: a coercive force (Hc) of 20–250 Oersted, a saturation magnetization (os) of 50–200 emu/g, and a residual magnetization (or) of 2–20 emu/g, and also a bulk density of 0.35 $g/cm^3$ or higher as measured according to JIS K5101 (pigment testing method).

The magnetic material may preferably be contained in the toner in a proportion of 40–150 wt. parts per 100 wt. parts of the binder resin.

The toner according to the present invention can also be constituted as a non-magnetic toner containing a non-magnetic colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a prescribed image density, and may be added in a proportion of 0.1–20 wt. parts, preferably 2–10 wt. parts, per 100 wt. parts of the binder resin. Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

In the toner according to the present invention, it is preferred to add a charge control agent in order to provide a charging stability and an improved developing performance.

Examples of the positive charge control agents may include: nigrosine, azine dyes having a $C_2$–$C_{16}$ alkyl group (JP-B 42-1627); basic dyes, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44025), C.I. Basic Green 1 (C.I. 42040) and C.I. Basic Green 4 (C.I. 42000); lake pigments of these basic dyes (the laking agents including, e.g., phosphotungstic acid, phosphomolybdic acid, phosphotungsticmolybdic acid, tannic acid, lauric acid, gallic acid, ferricyanates, and ferrocyanates); C.I. Solvent Black 3 (C.I. 26150), Hansa Yellow G (C.I. 11680), C.I. Mordant Black 11, and C.I. Pigment Black 1.

Further examples may include: quaternary ammonium salts, such as benzylmethylhexadecylammonium chloride, and decyltrimethylammonium chloride; amino group-containing vinyl polymers, and polyamide resins such as amino group-containing condensate polymers. Preferred examples may include: nigrosine, quaternary ammonium salts, triphenylmethane-type nitrogen-containing compounds, and polyamides.

Examples of the negative charge control agents may include: metal complexes of monoazo dyes as disclosed in JP-B 41-20153, JP-B 42-27596, JP-B 44-6397; and JP-B 45-26478; nitroamine acid, its salt and dyes or pigments such as C.I. 14645 as disclosed in JP-A 50-133338; complexes of metals, such as Zn, Al, Co, Cr and Fe with salicylic acid, naphthoic acid and dicarboxylic acid as disclosed in JP-B 55-42752, JP-B 58-41508, JP-B 58-7384 and JP-B 59-7385; sulfonated copper phthalocyanine pigment, nitro- or halogen-introduced styrene oligomers, and chlorinated paraffin. Preferred examples of the negative charge control agents may include: metal complexes of salicyclic acid, metal complexes of naphthoic acids, metal complexes of dicarboxylic acid, and metal complexes of derivative of there acids. In view of the dispersibility, it is particularly preferred to use an azo metal complex represented by the formula [III] below or a basic organic acid metal complex represented by the formula [IV] below:

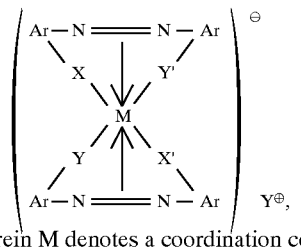

[III]

wherein M denotes a coordination center metal, inclusive of metal elements having a coordination number of 6, such as Cr, Co, Ni, Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $Y^+$denotes hydrogen, sodium, potassium, ammonium or aliphatic ammonium.

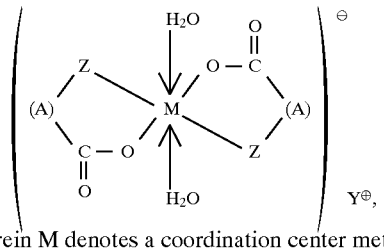

[IV]

wherein M denotes a coordination center metal, inclusive of metal elements having a coordination number of 6, such as Cr, Co, Ni, Mn and Fe; A denotes

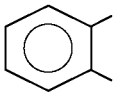

(capable of having a substituent, such as an alkyl),

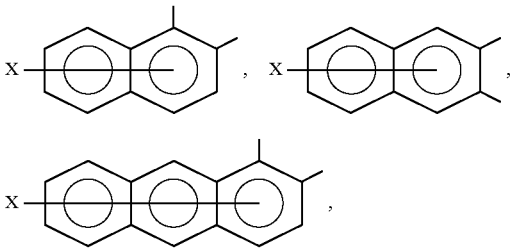

-continued

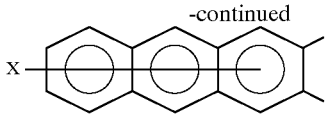

(X denotes hydrogen alkyl, halogen, or nitro),

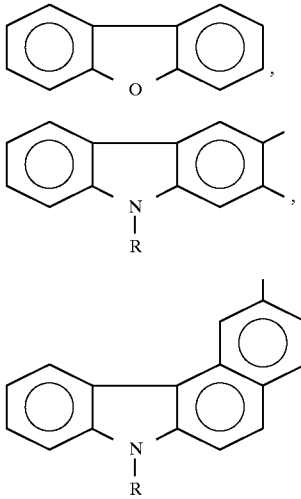

(R denotes hydrogen, $C_1$–$C_{18}$ alkyl or $C_1$–$C_{18}$ alkenyl); $Y^+$denotes a counter ion, such as hydrogen, sodium, potassium, ammonium, or aliphatic ammonium; and Z denotes —O—or —CO.O—.

Specific examples of the azo metal complex [III] and the basic organic acid metal complex [IV] may include the following:

Complex [III]-1

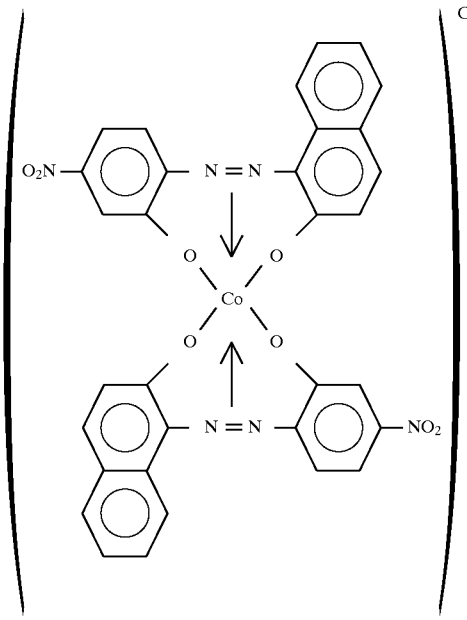

Complex [III]-2

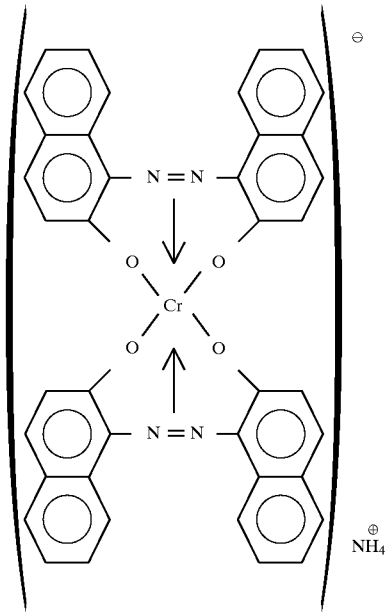

-continued
Complex [III]-3
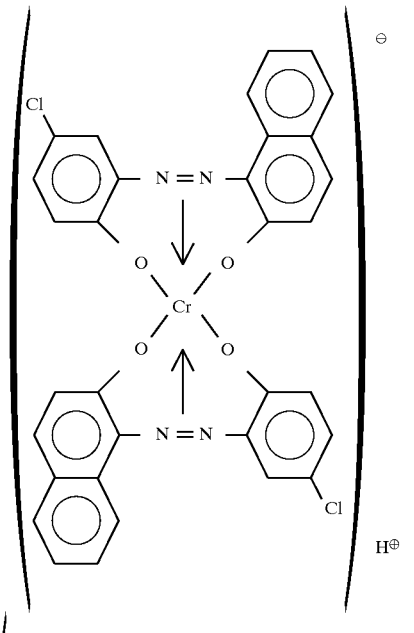
Complex [III]-4
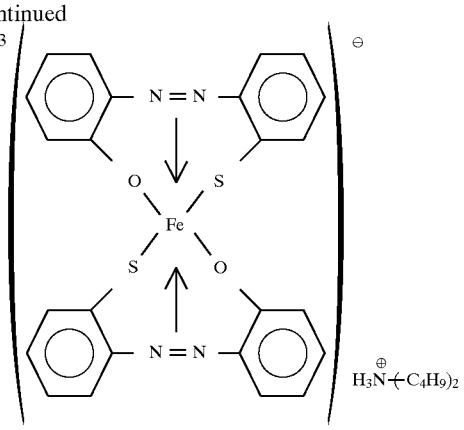
Complex [III]-5
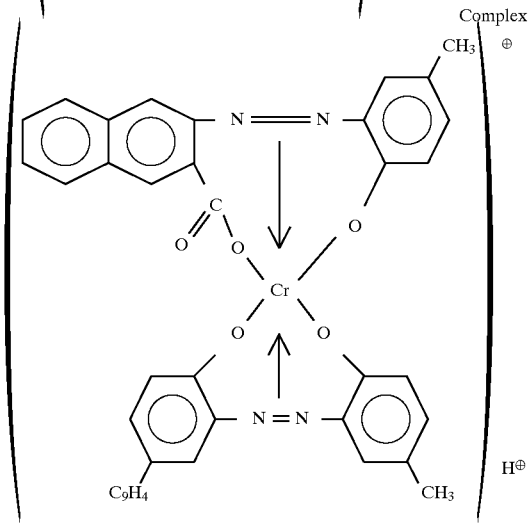
Complex [III]-6
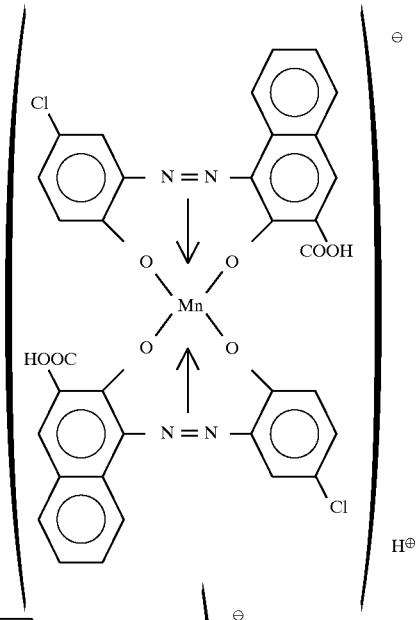
Complex [III]-7
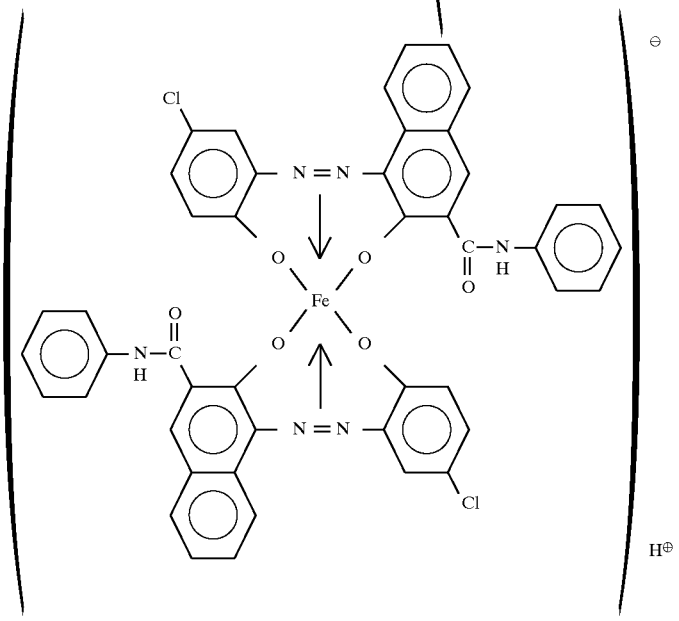

-continued
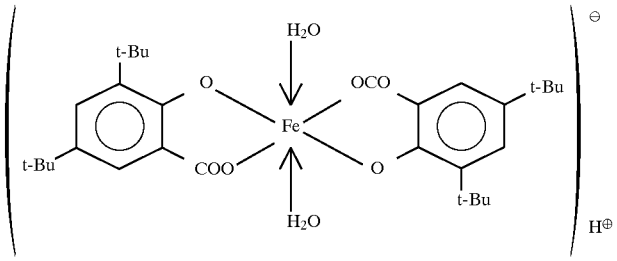
Complex [IV]-1
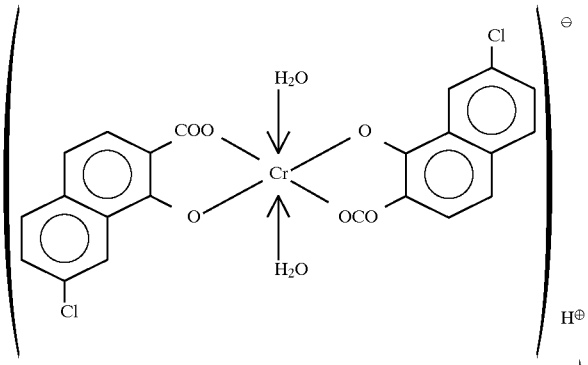
Complex [IV]-2
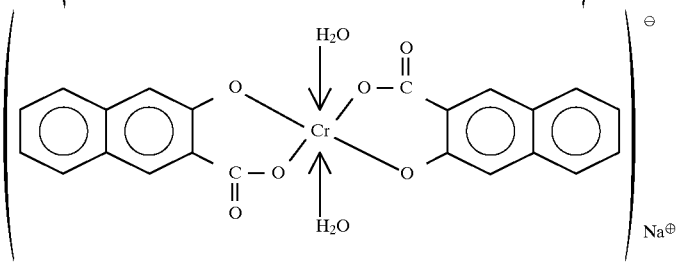
Complex [IV]-3
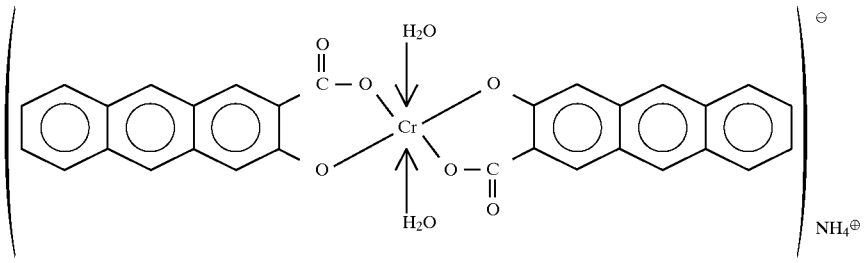
Complex [IV]-4
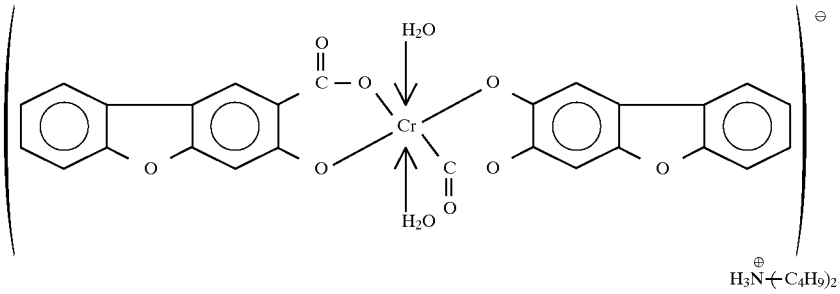
Complex [IV]-5
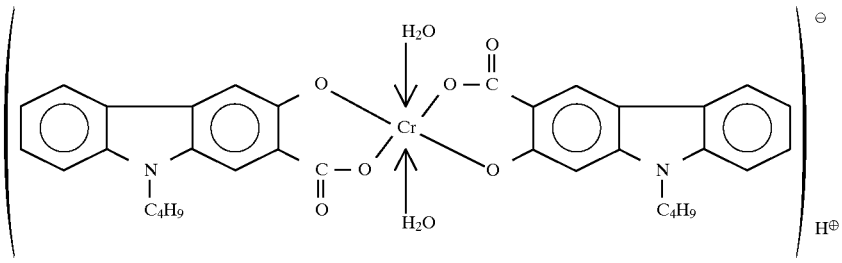
Complex [IV]-6

-continued

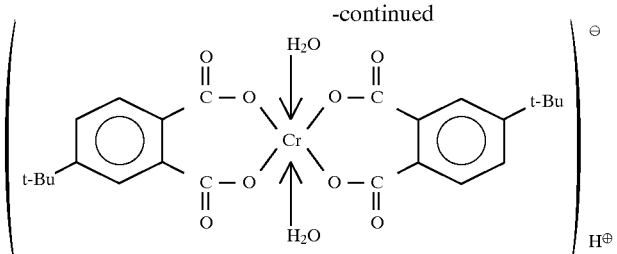

Complex [IV]-7

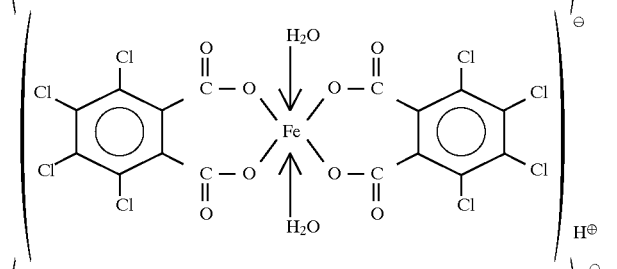

Complex [IV]-8

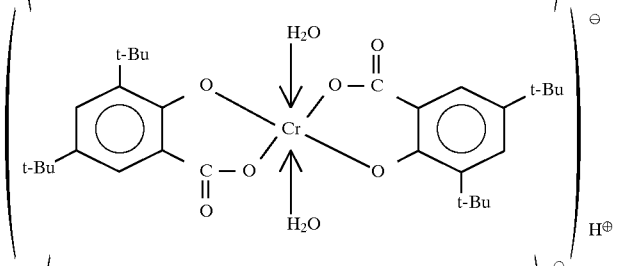

Complex [IV]-9

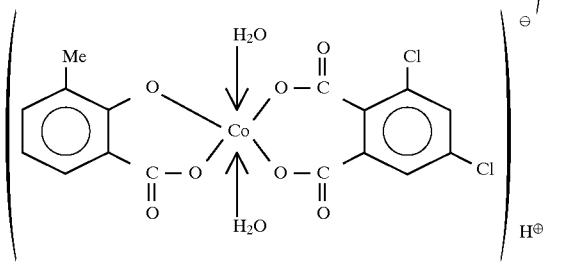

Complex [IV]-10

These metal complexes may be used singly or in combination of two or more species.

In case where the above metal complex is used as a charge control agent, the metal complex may preferably be added in an amount of 0.1–5 wt. parts per 100 wt. parts of the binder resin so as to retain a good triboelectric chargeability while minimizing adverse effects thereof, such as soiling of the developing sleeve surface leading to a lower developing performance and a lower environmental stability.

It is preferred to use the toner according to the present invention together with inorganic fine powder blended therewith in order to improve the charge stability, developing characteristic and fluidity.

The inorganic fine powder may include silica fine powder, titanium oxide fine powder and alumina fine powder. The inorganic fine powder used in the present invention provides good results if it has a specific surface area of 30 $m^2/g$ or larger, preferably 50–400 $m^2/g$, as measured by nitrogen adsorption according to the BET method. The inorganic fine powder may be added in a proportion of 0.01–8 wt. parts, preferably 0.1–5 wt. parts, per 100 wt. parts of the toner particles.

For the purpose of being provided with hydrophobicity and/or controlled chargeability, the inorganic fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner particles as a development characteristic improver.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may include: powder having magnetism, such as iron powder, ferrite powder, and nickel powder; glass beads; and carriers obtained by coating these powders or beads with a resin, such as a fluorine-containing resin, a vinyl resin or a silicone resin.

Figure 3:
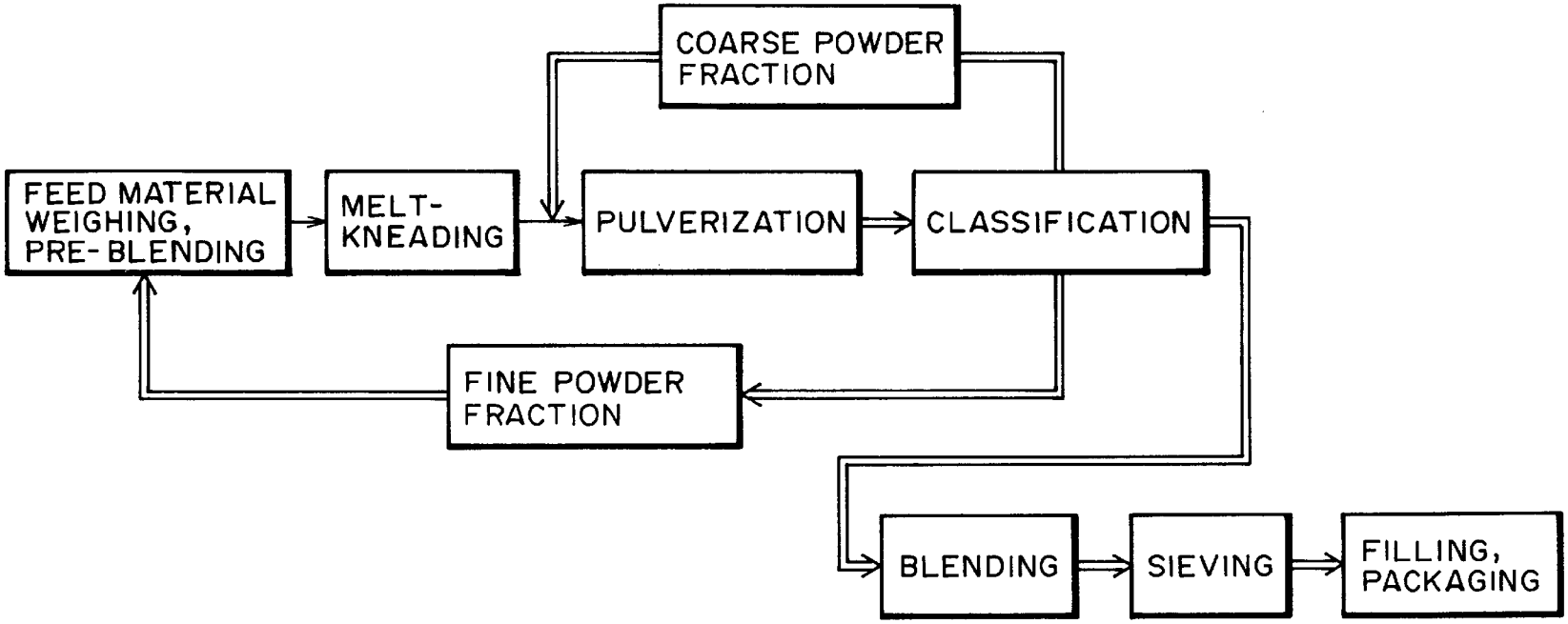
FIG. 3 is a flow chart of an embodiment of toner production according to the melt-kneading-pulverization process.

Next, some embodiments of the process for producing a toner for developing electrostatic images and production apparatus systems suitable for practicing the process will be described with reference to the drawings. FIG. 3 is a flow chart for illustrating one embodiment of the meltkneading-pulverization process.

Referring to FIG. 3, the process includes a preliminary blending step of weighing and preliminarily blending sufficiently the feed materials for constituting a toner including a binder resin, a colorant, a low-molecular weight wax and other additives by means of a blender, such as a Henschel mixer or a ball mill to prepare a blend; a melt-kneading step of melting and kneading the blend by means of a hot kneading means, such as hot rollers, a kneader or an extruder to disperse the colorant, the low-molecular weight wax, etc., in the binder resin; a pulverization step of pulverizing the kneaded product after cooling; a classification step of classifying the pulverized product; further, an external addition step of blending the classified powder with optional additives, such as an inorganic fine powder, by a blender, such as a Henschel mixer; a sieving step of sieving the toner for removing coarse agglomerates of external additive and melt-agglomerate of toner particles formed during the external addition step; and a packaging step of filling and packaging the product toner. In the classification step, a coarse powder fraction having a particle size exceeding a prescribed range is recycled to the pulverization step, and a fine powder fraction having a particle size below the prescribed range is recycled to the preliminary blending step.

In the case of producing the toner for developing electrostatic images according to the meltkneading-pulverization process, it is preferred to melt-knead a toner composition including the low-molecular weight wax having the above-mentioned thermal properties under a condition providing a melt-viscosity of $10^2$–$10^6$ poise as measured by a Bookfield-type viscometer, and cool the melt-kneaded product at a rate of 1°–20° C./sec to provide a solidified product to be pulverized. As a result, it becomes possible to isolate 10–500 wax particles, preferably 10–100 wax particles, per 10,000 toner particles. Then, the resultant powdery mixture of the toner particles and the low-molecular weight wax particles is transported pneumatically within the production steps connected with arrow-headed double lines and through the transportation pipes connecting the steps by means of injection feeders, whereby the isolated low-molecular weight wax particles are allowed to continually form a coating film showing a releasability on the inner walls of the production apparatus and the transportation pipes. As a result, the maintenance operation of the toner production facility becomes almost unnecessary to allow the production of a low temperature-fixable soft toner at a high productivity.

In the case of producing the toner through the meltkneading-pulverization process, the melt-kneading step, the pulverization step and the classification step may preferably be operated under conditions and using apparatus as described below so as to realize a high production efficiency and provide a toner with totally improved performances.

In the melt-kneading step, it is preferred to use a single-screw or a twin-screw extruder in view of a good dispersion of toner constituent materials and ability of continuous production. In order to provide a preferable dispersion state of the low-molecular weight wax, it is particularly preferred to use a twin-screw extrusion kneader.

Figure 4:
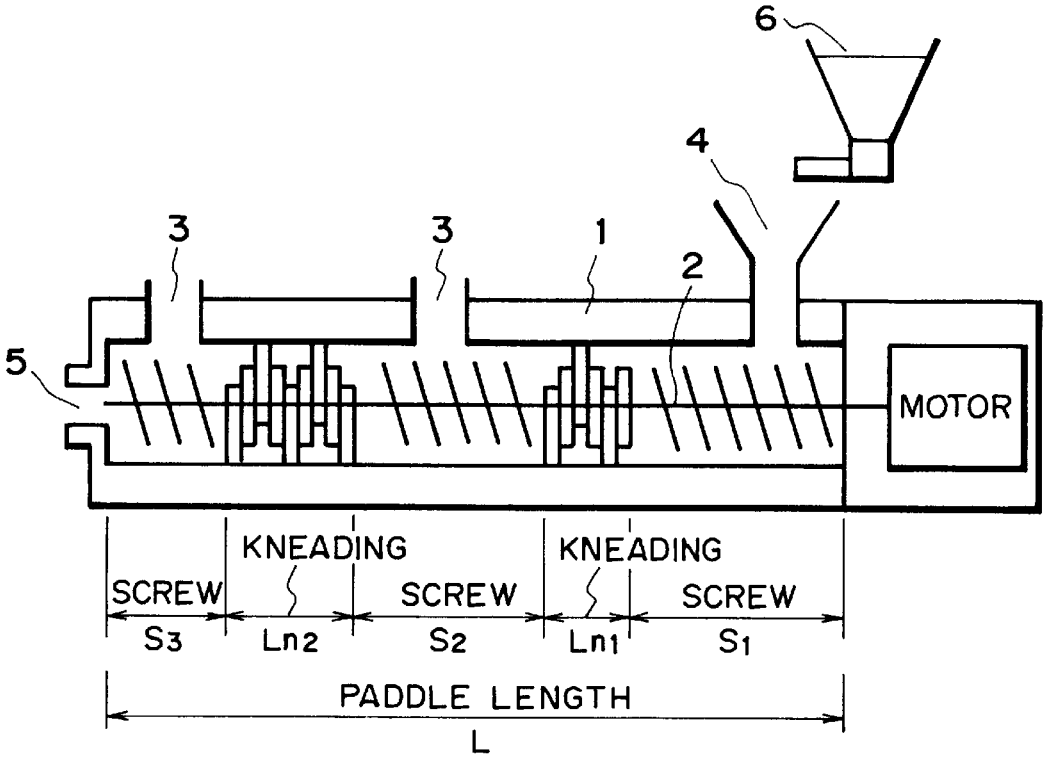
FIG. 4 is an illustration of a kneading apparatus suitably used in the production process according to the invention.

As shown in FIG. 4, a twin-screw extrusion kneader is generally provided with two rotation shafts 2 called paddles extending through a heating cylinder 1 for keeping constant the temperature. The feed material 6 is supplied from one end of the heating cylinder through a hopper 4, heated into a molten state and kneaded by the rotating paddles 2 to be extruded out of the other end 5. At an intermediate point, it is possible to provide a vent hole 3 principally for degassification.

Figure 5:
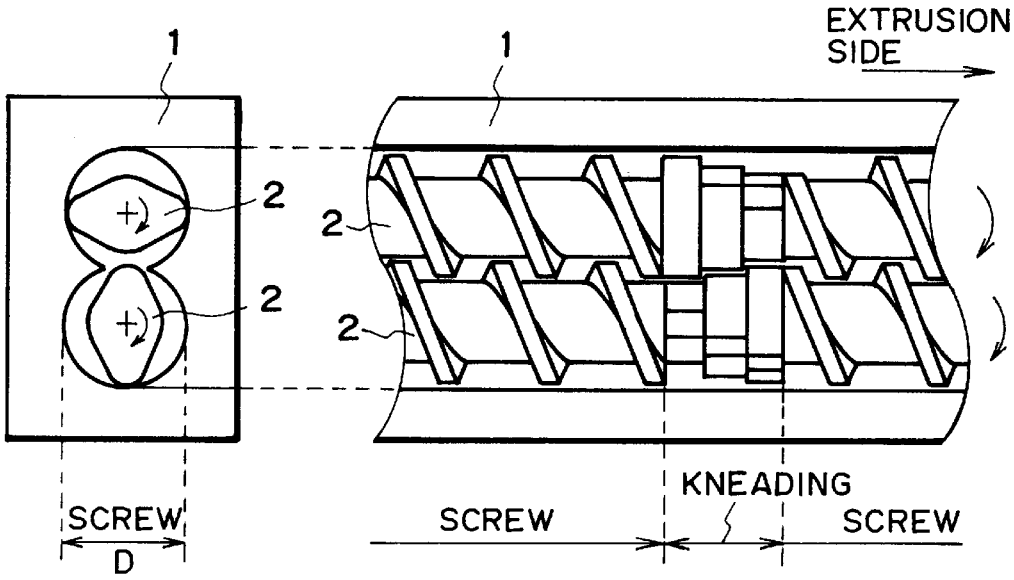
FIG. 5 is an enlarged illustration of the paddle in the kneading apparatus of FIG. 4.

FIG. 4 shows an outline of an extrusion kneader preferably used in the present invention and FIG. 5 shows an enlarged illustration of the paddles therein.

Referring to FIG. 5, paddles 2 disposed within a heating cylinder 1 may be propeller-shaped as shown or triangular and are set with a phase shift therebetween so as to rotate in such a manner that one paddle tip always rubs the other. Because of the structure, the extruder can exhibit a self-cleaning function so that the kneaded product is fed forward without being attached to the paddle wall and cylinder wall. The two paddles 2 may be rotated in either identical directions or different directions but generally in identical directions.

The paddles 2 are roughly composed of two types of sections. One is a screw section having a function of feeding the kneaded product forward while heating the material, and the other is a kneading function having substantially no forward feeding function where the kneaded material is stagnant and filled to cause volumetric changes accompanying compressions and stretching for kneading due to rotation of the paddles.

In the case of kneading a soft toner composition aiming at low-temperature fixation as in the present invention, substantially no kneading is caused at the screw sections so that, if the kneading section is short, the feed material constituting the toner composition can be extruded out before it reaches a complete molten state. In this way, in the case of using a melt-kneading apparatus like an extrusion kneader, it is important to appropriately set the conditions, such as the heating temperature, the paddle structure, the rotation speed of the paddles and the throughput of the feed material.

In the present invention, in order to provide an improved dispersibility of the toner constituent materials in a state giving a melt viscosity of $10^2$–$10^6$ poises of the toner composition, the extrusion kneader may preferably have a paddle total length L (cm), a screw diameter D (cm), a throughput W (kg/hr) of a toner constituent material mixture (i.e., a raw material of toner composition, and a paddle rotation speed R (rpm) set to satisfy the following formula (C):

$$2 \leqq (L/D) \times (W/R) \leqq 100 \qquad \text{(C)}.$$

As a result, the kneading intensity and the residence time of the kneaded toner composition in the extrusion kneader are optimized so that the toner constituent materials are melted and kneaded without excess or shortage. Accordingly, the low-molecular weight wax is well dispersed in the binder resin and may be partially isolated under an appropriate cooling condition of the melt-kneaded product to provide a preferred isolation state of the low-molecular weight wax particles.

In case where the above (L/D)×(W/R) parameter is below 2, the toner composition is merely in a softened state, thus being liable to cause a dispersion failure. On the other hand, if the parameter exceeds 100, the constituent materials in the kneaded material are liable to cause re-agglomeration and rather results in a lower dispersibility. These phenomena become pronounced in production of a magnetic toner wherein uniform dispersion of high-density fine particles of magnetic material is a critical factor.

On the other hand, by providing two or more kneading sections, the re-agglomeration of the component materials can be prevented to provide a better dispersion state. Particularly, if the kneading sections are set to have a total length Ln (=$Ln_1$+$Ln_2$ +. . . ) occupying 5–30% of the whole paddle length L (Ln/N=0.05–0.3), the shearing force applied to the kneaded material can be optimized without impairing the dispersibility in the melt-kneading, whereby the re-agglomeration of the toner component materials and the severance of the molecular chains of the binder resin are suppressed to provide good developing performance and anti-high temperature offset characteristic. In case where only one kneading section is provided, the residence time of the kneaded material may be too short or the re-agglomeration can be promoted at the screw section, thus being liable to cause a dispersion failure. In this instance, if the kneading section is made longer, the molecular chain severance can be promoted to result in a lower high anti-high temperature offset characteristic.

On the other hand, in the pulverization step, various pulverization apparatus may be used as pulverization means. It is particularly preferred to use a jet pneumatic pulverizer using a jet air stream or a mechanical collision-type pulverizer.

Figure 6:
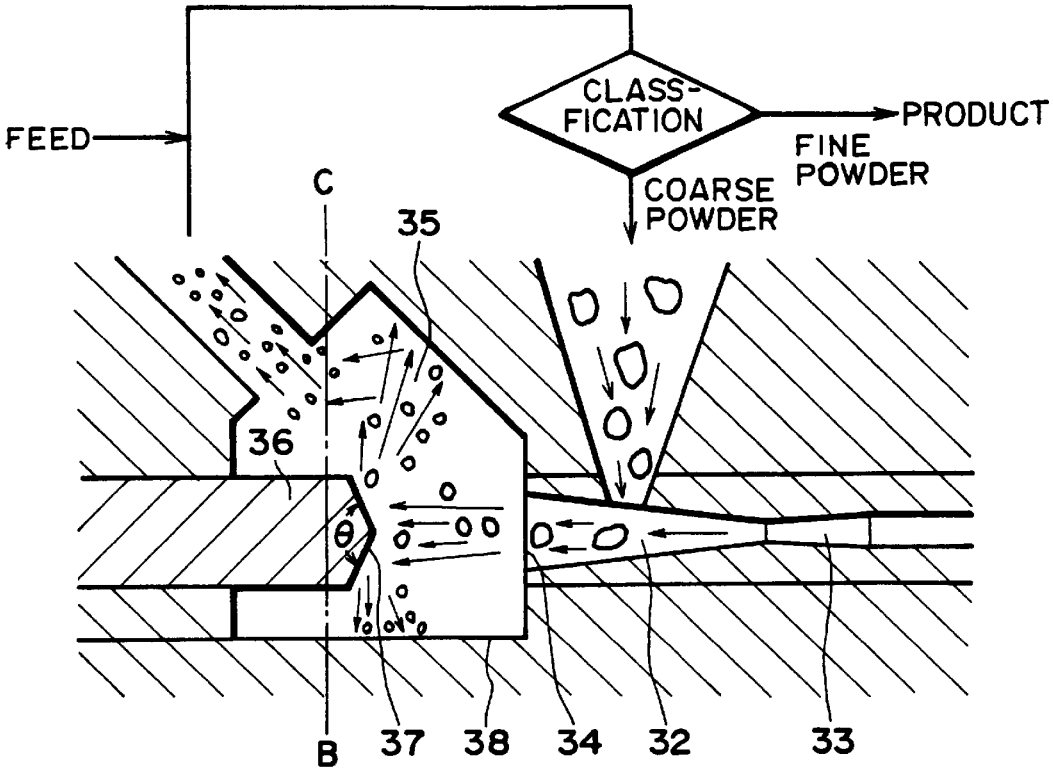
FIG. 6 is an illustration of a jet-type pneumatic pulverizer.
Figure 7:
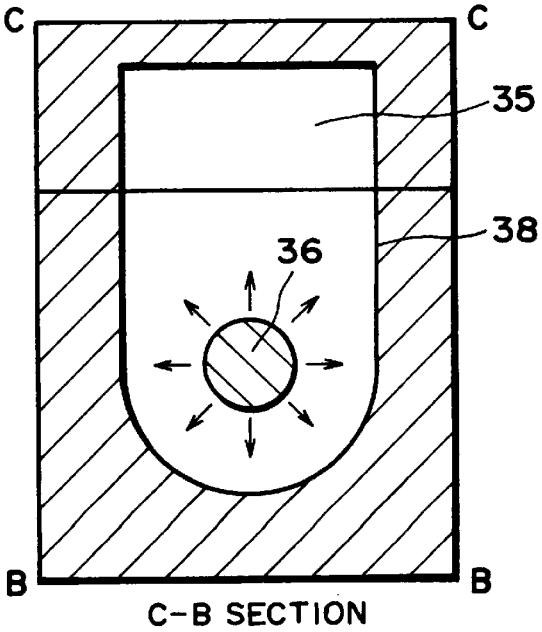
FIG. 7 is an enlarged view a B-C section in FIG. 6.

A let or pneumatic collision-type pulverizer as represented by a jet mill (e.g., "Model RJM-1", available from Nippon Pneumatic Kogyo K.K.) is generally a type of pulverizer wherein the powdery feed material is caused to collide with a collision member to be pulverized under the action of the collision force. More specifically, as shown in FIGS. 6 and 7, a pulverizer includes a supply nozzle 33 for supplying a high-pressure air, an accelerating tube 32 for conveying and accelerating the powder feed under the action of the high-pressure air, a pulverization chamber 35, and a collision member 36 for pulverizing the powder ejected out of the accelerating tube 32 and colliding therewith under the action of a collision force. The collision member 36 is disposed with the pulverization chamber 35 so as to have a collision surface 37 opposite the outlet 34 of the accelerating tube 32. The inner wall 38 of the pulverization chamber 35 has a function of further pulverizing the pulverized powder from the collision surface. The collision surface 37 of the collision 36 may have a conical shape forming an apex angle (θ) of preferably 110–175 deg., more preferably 120–170 deg., so as to provide an improved pulverization efficiency and prevent the secondary agglomeration within the pulverizer.

The collision surface of the collision member 36 can also be provided with a two-step sloping structure including a first apex portion forming an apex angle of 10–80 deg., and a second duller-slope skirt portion forming an apex angle (when extended) of 110–175 deg., preferably 120–170 deg. slope angle of 10–80 deg.

Hitherto, when a collision-type pneumatic pulverizer as described above is used for production of a soft toner aiming at low-temperature fixation, the melt-sticking or solidification of the toner on the collision surface 37 and the pulverization chamber inner wall 38 has been liable to occur, so that a periodical maintenance operation is required for the pulverizer or the pressure of the high-pressure air ejected out of the supply nozzle 33 has to be suppressed. In the present invention, however, as the powder feed contains a prescribed amount of isolated particles of the low-molecular weight wax containing the compound of the formula R-Y, a coating layer of the low-molecular weight wax is formed on the pulverizer inner wall, so that the melt-sticking or solidification of the powdery toner composition within the apparatus can be prevented or suppressed.

A major proportion of the isolated low-molecular weight wax particles co-present with toner particles is generated during the pulverization step. The kneaded product of the soft toner composition containing the low-molecular weiaht wax finely dispersed in a preferable dispersion state through the previous melt-kneading step is coarsely pulverized (or crushed) and then finely pulverized by a collision-type pneumatic pulverizer, when a portion of the low-molecular weight wax present at the pulverization surface of each toner composition particle is isolated and dispersed into the pulverized toner composition particles under the action of the high-pressure air. As a result, at parts at which the high-pressure air intensely acts or the density of the toner composition particles becomes high, a coating layer of the low-molecular weight wax is quickly formed to prevent the powder melt-sticking or solidification. By providing the front part of the collision surface with a conical shape as described above, the isolated particles of the low-molecular weight wax is scattered over a wide range within the pulverization chamber 35, so that the coating layer is very effectively formed within the pulverization chamber.

The classification apparatus used as a classification means in the classification step may include a rotor-type classifier wherein a whirling air stream is forcibly generated by rotation of classifying blades to effect classification, and a spiral pneumatic classifier as represented by a dispersion separator ("Model DS-UR", available from Nippon Pneumatic Kogyo K.K.) wherein a whirling air stream is formed by air stream introduced from outside to effect classification.

Figure 8:
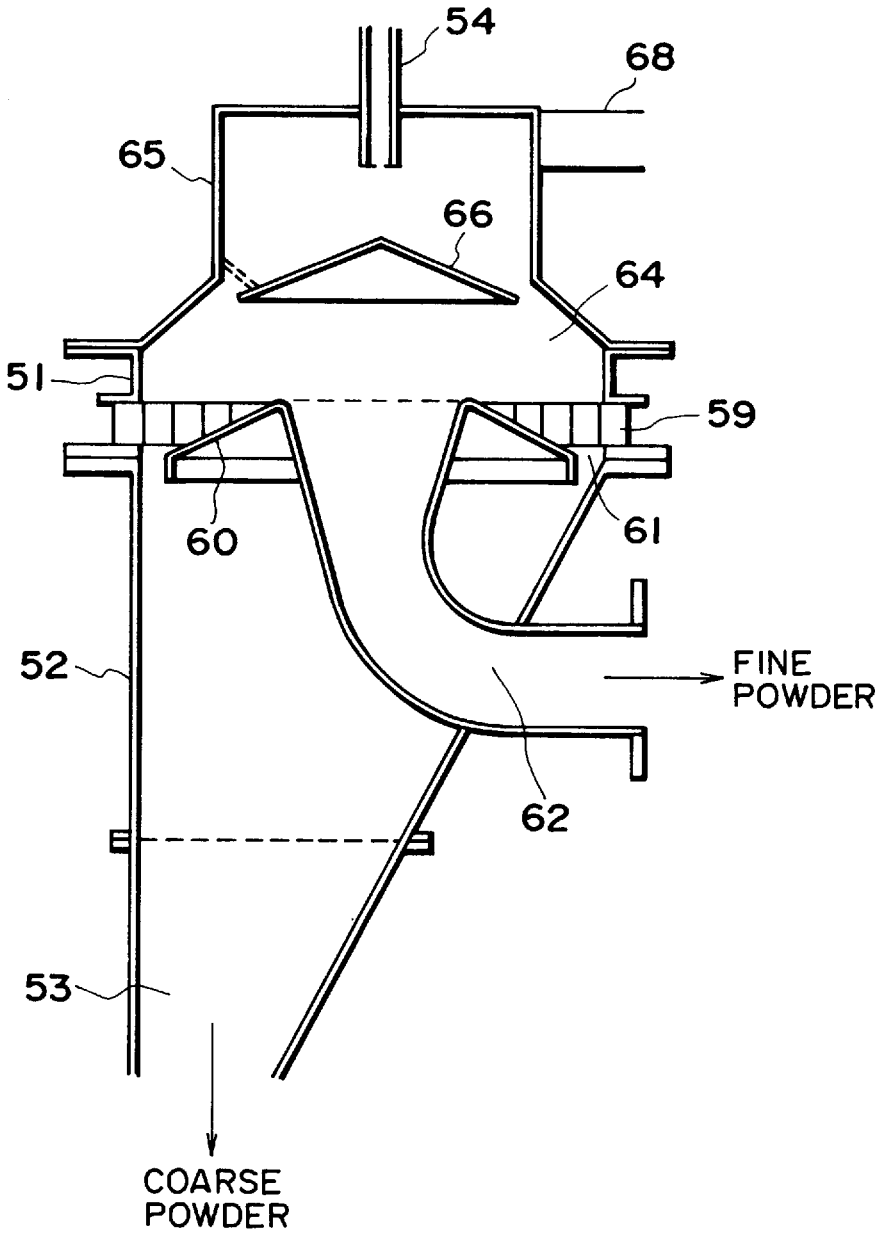
FIG. 8 is a sectional illustration of a classifier using a whirling air stream suitably used in the production process of the invention.

FIG. 8 is a sectional illustration showing an outline of a dispersion separator. Referring to FIG. 8, the separator includes a tubular body casing 51, a lower casing 52, a hopper 53 for coarse powder discharge connected to a lower part of the casing 52. Above the body casing 51, a classifying chamber 64 is formed and provided with a feed supply unit 68 in the form of a cyclone for supplying a powder feed to the classifying chamber 64. The upper part of the classifying chamber 64 is closed with an annular guide chamber 65 attached to an upper portion of the body casing 51 and a conical-shaped (umbrella-shaped) upper cover 66 having a higher central portion.

The lower part of the body casing 51 is provided with classifying louvers arranged circumferentially, so that a classifying air is introduced from outside through the classifying louvers 59 to cause a whirling stream in the classifying chamber 64.

At the bottom of the classifying chamber, a classifying plate 60 having a shape of a central high cone or an umbrella is disposed so as to leave a discharge outlet 61 for coarse powder surrounding the classifying plate 60. At a central part of the classifying plate 60, a fine powder discharge chute 62 is connected so that a lower end of the chute 62 is bent in a shape of character "L" and the bent end is disposed outside the side wall of the lower casing 52. Further, the chute 62 is connected to a suction fan (not shown) via a fine powder recovery means, such as a cyclone or a dust collector. By the operation of the suction fan, a suction force is caused within the classifying chamber 64 to introduce sucked air between the louvers 59 into the classifying chamber and cause a whirling stream required for classification.

The powder whirling into the classifying chamber 64 is carried together with sucked air entering between the louvers 59 at the lower part of the classifying chamber 64 by the action of the suction fan connected to the fine powder discharge chute 62 to enhance its whirling and be centrifugally separated into coarse powder and fine powder due to a centrifugal force acting on individual particles. As a result, the coarse powder whirling along an outer peripheral portion within the classifying chamber 64 is discharged out of the coarse powder discharge outlet 61. On the other hand, the fine powder moving along the upper sloping surface of the classifying plate 60 toward the central portion is trapped by and discharged through the fine powder discharge chute 62 to a fine powder recovery means.

All the air entering the classifying chamber 64 together with the powder feed forms a whirling stream, so that the inwardly directed speed of particles is relatively smaller than the centrifugal force and a small diameter particle separation can be effected in the classifying chamber 64 to allow the discharge of fine powder having a very small particle size through the discharge chute 62. Further, as the powder feed is introduced into the classifying chamber at a substantially uniform density, accurate powder classification can be performed.

In this type of classification apparatus using a whirling air stream, the powder material receives a strong stress due to a high-speed whirling stream. Further, at the upper cover 66, the classifying louver 59, the classifying plate 60, etc., the particle density of the powder material becomes high, so that the classification is liable to be hindered and the powder is liable to be agglomerated. Accordingly, hitherto, if this type of classifier is used for classification of soft toner composition powder, the melt-sticking and solidification of the powder has occurred at the above-mentioned parts and the elbowed wall portion of the fine powder discharge chute 62. However, by feeding the toner composition particles containing a prescribed amount of isolated particles of the low-molecular weight wax comprising the formula R-Y, the coating layer showing an improved releasability is formed at such parts to prevent the melt-sticking and solidification of the powder.

Even at parts on which a whirling stream intensity acts and at which the toner composition particle density becomes high, the coating layer of the low-molecular weight wax prevents the above-mentioned problems. Further, because of the formation of the coating layer of the low-molecular weight wax showing releasability, the movement of the toner composition particles is made smooth, so that it becomes possible to recover toner particles having a better particle size distribution at a better efficiency. The coating layer is repetitively renewed and reformed by supply of fresh low-molecular weight wax particles, so that a powdery product having a high abrasion characteristic, such as magnetic toner particles, can be continuously produced for a long period, so that the toner quality and productivity are improved.

The toner production process according to the present invention remedies the problems of a classifier using a whirling air stream as described above and can also enhance the productivity, thus showing a good compatibility with such a classifier.

Figure 9:
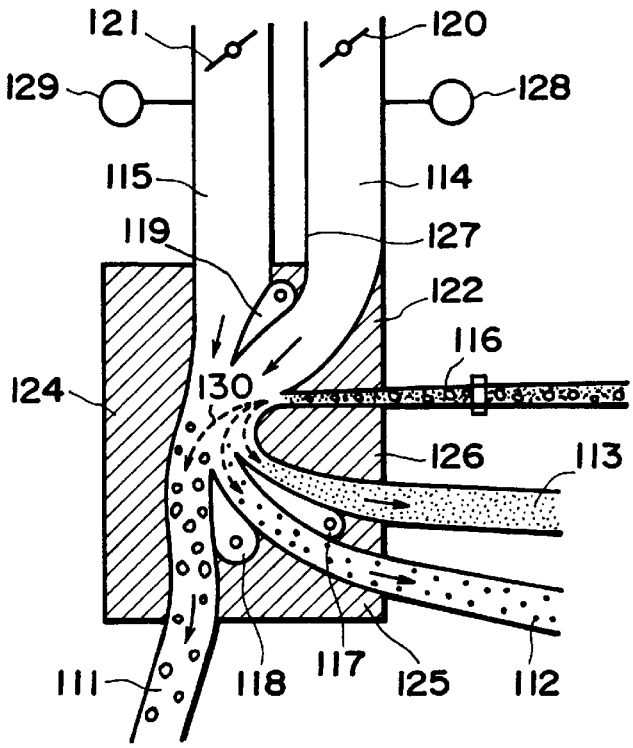
FIGS. 9 and 10 are a sectional illustration and an inner perspective view, respectively, of a multi-division classifier suitably used in the production process of the invention.
Figure 10:
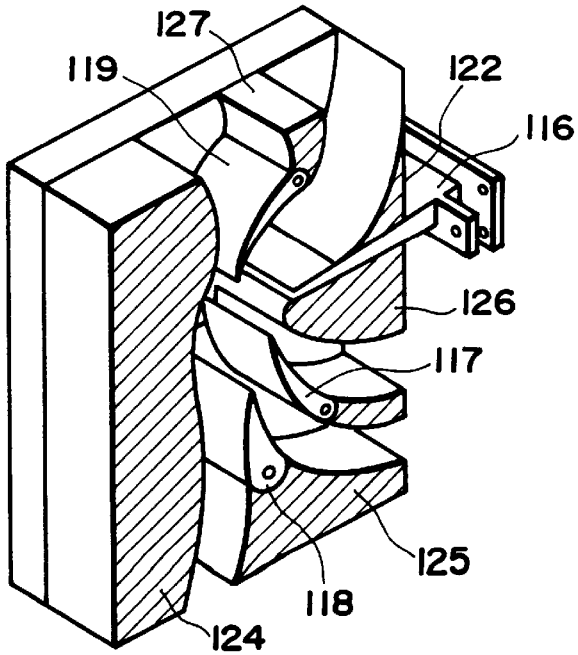

On the other hand, in case of requiring a further accurate classification, a multi-division classifier as shown in FIG. 9 (sectional illustration) and FIG. 10 (inner perspective illustration) is particularly preferably used. Referring to FIGS. 9 and 10, the classifier includes side walls 122 and 124 having shapes as shown and a lower wall 125 having a shape as shown. The lower wall 125 is provided with classifying edges 117 and 118, in the form of knife edges, so as to divide the classifying zone in three sections. Below the side wall 122 is disposed a feed supply pipe 116 opening into a classifying chamber. Below the supply pipe 116, a Coanda block 126 is disposed so as to extend along a lower tangential line of the supply pipe 116 and be folded downwardly to form a long elliptical arcuate section. Above the classifying chamber, an upper wall member 127 equipped with an intake edge 119 in the form of a knife edge is disposed, and also gas intake pipes 114 and 115 are disposed so as to respectively open into the classifying chamber. The gas intake pipes 114 and 115 are equipped with first and second gas intake control means 120 and 121, such as dampers, and static pressure gauges 128 and 129. The classifying edges 117 and 118 and the gas intake edge 119 are respectively disposed movably, and their positions are controlled depending on the kind of the feed powder to be classified and the objective particle size. At the bottom of the classifying chamber are disposed exhaust pipes 111, 112 and 113 opening into the classifying chamber so as to correspond to the respective classifying sections. The exhaust pipes 111, 112 and 113 can be respectively provided with shutter means such as valves.

The feed supply pipe 116 will now be described in further detail while referring to the drawings.

The feed supply pipe 116 comprises a rectangular non-tapered tube and a rectangular tapered tube section. An appropriate injection velocity may be attained if the inner transverse sectional area of the non-tapered tube and the inner transverse sectional area of the narrowest part of the rectangular tapered tube are set to provide a ratio of 20:1 to 1:1.

The classifying operation in the multi-division classifier may for example be performed in the following manner. A reduced pressure is generated in the classifying chamber by evacuation through at least one of the exhaust pipes 111, 112 and 113, and the feed powder is supplied into the classifying chamber through the feed supply nozzle 116 together with an accompanying gas stream flowing at a rate of 50–300 m/sec owing to the reduced pressure through the feed supply nozzle 116 opening into the classifying chamber.

The feed powder thus supplied is caused to move along curved lines 130 due to the Coanda effect given by the Coanda block 126 and the action of the accompanying gas stream and, depending on the sizes of individual particles, is divided into a coarse powder fraction (over the prescribed particle size range) falling outwardly (i.e., outside the classifying edge 118), a medium particle fraction (within the prescribed size range) falling between the classifying edges 117 and 118, and a fine powder fraction (below the prescribed size range) falling inside the classifying edge 117. Then, the coarse powder fraction, the medium powder fraction and the fine powder fraction are discharged through the exhaust pipes 111, 112 and 113, respectively.

Also in the case of classifying the soft toner composition powder in the multi-division classifier, the melt-sticking and solidification of the powder liable to occur on the surfaces of the feed supply nozzle 116 through which a very high speed air stream is flown and the Coanda block 126 and the tips of the classifying edges 117 and 118 at which the powder particle density becomes high, can be effectively prevented by the isolated particles of the low-molecular weight wax represented by the formula R-Y. If the melt-sticking or solidification of the powder occurs on the surfaces of the feed supply nozzle 116 and the Coanda block 126, the classification accuracy and the classification are adversely affected. Further, if the melt-sticking or solidification of the powder is caused and grown on the classifying edges, the classification points are shifted so that it becomes impossible to obtain a powder product having a desired particle size distribution. In the present invention, the above-mentioned problems are solved by the formation of a releasable coating film layer with the low-molecular weight wax particles. Further, the powder flow state is improved to synergistically improve the Coanda effect. Particularly, even in the case of production of a smaller particle size toner, the removal of fine powder adversely affecting the toner quality is facilitated to improve the classification accuracy.

Accordingly, the toner production process according to the present invention shows a good compatibility (matching) with the above-mentioned multi-division classifier, so that it is possible to effectively produce toner particles having an accurate particle size distribution and thus showing a high quality.

Figure 11:
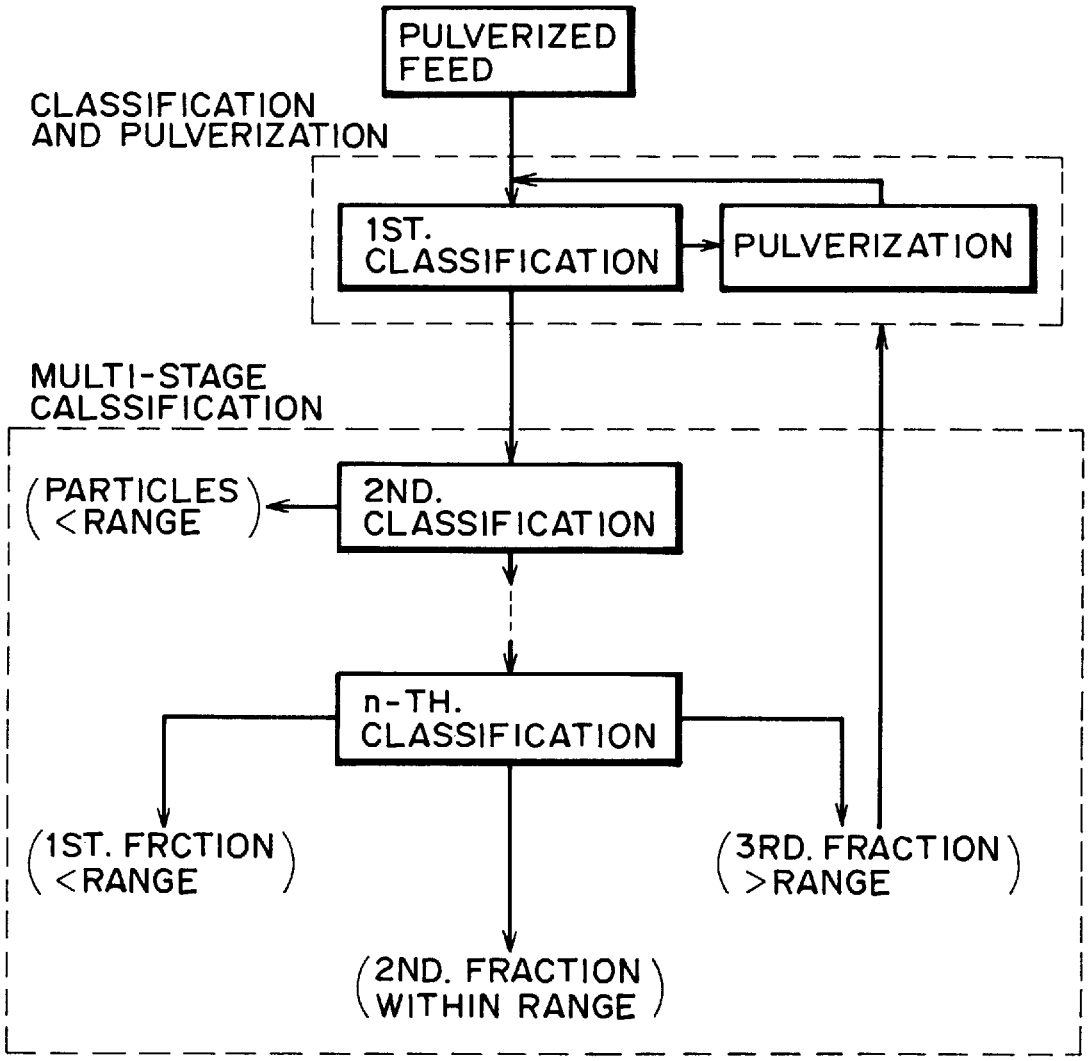
FIG. 11 is a flow chart for illustrating an embodiment of the process according to the invention.
Figure 12:
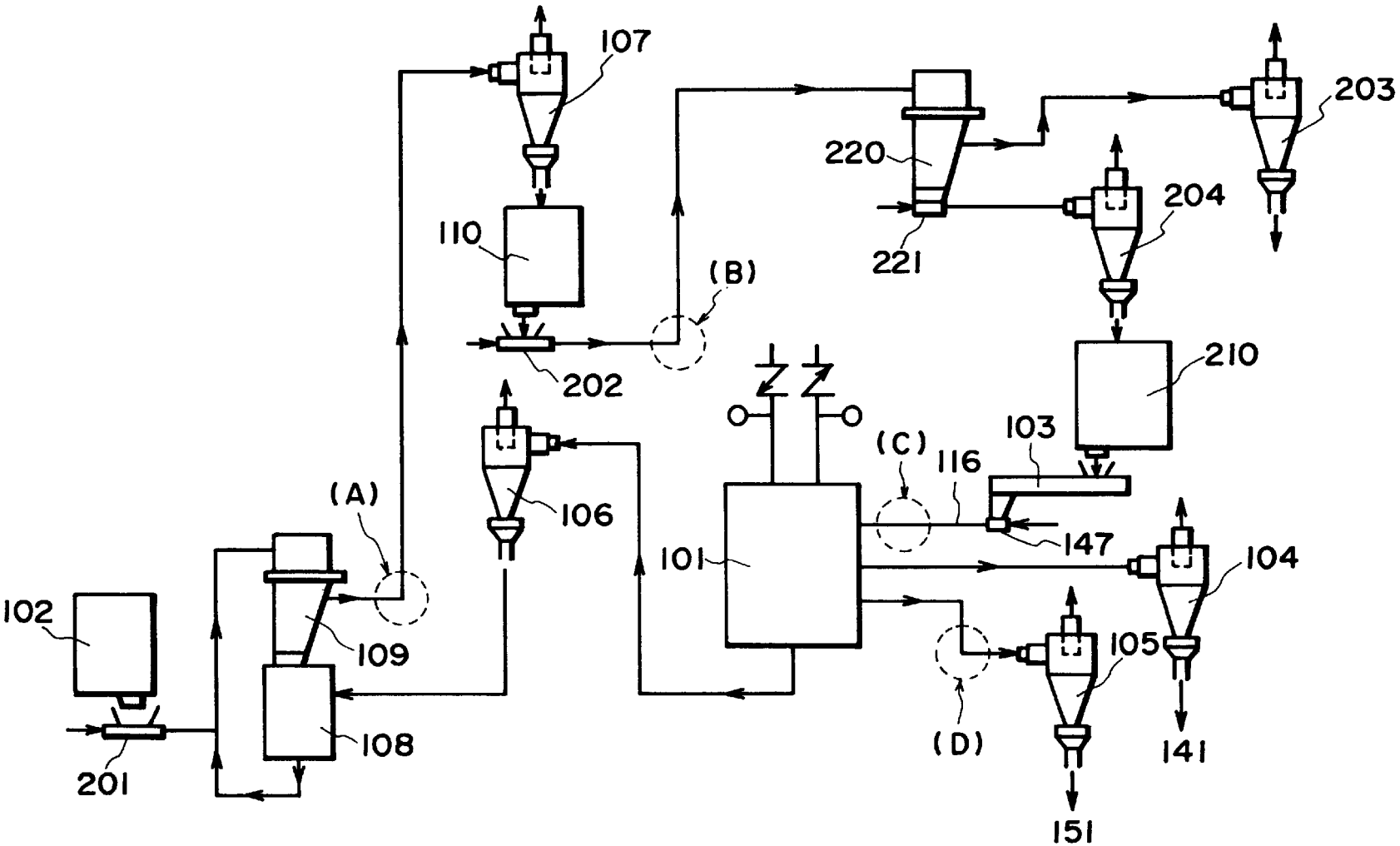
FIG. 12 is an illustration of an apparatus system for practicing an embodiment of the production process according to the invention.

FIG. 11 is a flow chart for illustrating an embodiment of the toner production process, and FIG. 12 is an illustration of an apparatus system for practicing an embodiment of the toner production process.

In the apparatus system shown in FIG. 12, a pulverized feed formed by cooling and coarsely pulverizing the melt-kneaded product is supplied via a first metering feeder 102 and then supplied by an injection feeder 201 into a first classifier 109, from which a first classified fine powder is supplied via a collecting cyclone 107 to a second metering feeder 110 and then supplied by an injection feeder 202 into a second classifier 220. On the other hand, a first coarse powder from the first classifier 109 is fed to a fine pulverizer 108 and, after fine pulverization, re-introduced into the first classifier 109 together with a fresh pulverized feed.

The first fine powder introduced into the second classifier 220 is classified into a second fine powder and a second coarse powder. The first fine powder is recovered by a collecting cyclone 203. The second coarse powder is supplied via an injection feeder 221 and a collecting cyclone 204 to a third metering feeder 210, and then introduced via a vibration feeder 103, an injection feeder 147 and a powder supply nozzle 116 into a third classifier (multi-division classifier) 101. The second coarse powder introduced into the third classifier 101 is classified into a fine powder fraction, a medium powder fraction and a coarse powder fraction. The coarse powder fraction is recovered by a collecting cyclone 106 and then introduced into the fine pulverizer 108 (or first classifier 109). The fine powder fraction is recovered by a collecting cyclone 104 to provide a fine powder 141 which is recycled to the preliminary blending step, and the medium powder fraction is recovered by a collecting cyclone 105 to provide a medium powder 151 constituting an embodiment of the toner according to the present invention.

In order to provide an improved toner production efficiency, the powder-air transporting speed at a section immediately after the injection feeder 201, the section (A) and the section (C) in FIG. 12 may preferably be set to at least 35 m/sec.

Hereinbelow, the present invention will be described more specifically based on Examples.

PRODUCTION EXAMPLE 1 FOR BINDER RESIN

Into a reaction vessel, 200 wt. parts of xylene was charged and heated to reflux temperature. Then, a mixture solution of 85 wt. parts of styrene, 15 wt. parts of n-butyl acrylate and 2 wt. parts of di-tert-butyl peroxide was added dropwise and subjected to solution polymerization for 7 hours under reflux of xylene to obtain a low-molecular weight resin solution.

Separately, 70 wt. parts of styrene, 25 wt. parts of butyl acrylate, 5 wt. parts of mono-butyl maleate, 0.005 wt. part of divinylbenzene, 0.2 wt. part of polyvinyl alcohol, 200 wt. parts of de-gassed water, and 0.1 wt. part of benzoyl peroxide were mixed and dispersed to form a suspension dispersion liquid, which was then heated and held at 85° C. for 24 hours in a nitrogen atmosphere to complete polymerization, thereby obtaining a high-molecular weight resin. The resin was washed with NaOH aqueous solution in an amount two times equivalent to the acid value of the resin. Then, 30 wt. parts of the high-molecular weight resin was charged into the above-mentioned solution after the solution polymerization containing 70 wt. parts of the low-molecular weight resin, and completely dissolved therein to effect the mixing, followed by distilling off the solvent to obtain Binder Resin (1).

As a result of Measurement, Binder Resin (1) exhibited a low molecular weight-side peak molecular weight ($P_1MW$) of 6000, a high molecular weight-side molecular weight ($P_2MW$) of $88\times10^4$, a weight average molecular weight (Mw) of $36\times10^4$, a number-average molecular weight (Mn) of $0.55\times10^4$, and an Mw/Mn ratio of 65. Binder Resin (1) contained 1 wt. % of THF-insoluble matter and had a glass transition point (Tg) of 59° C.

PRODUCTION EXAMPLE 2 FOR BINDER RESIN

Into a reaction vessel, 43 mol. % of isophthalic acid, 5 mol. % of trimellitic anhydride, 19 mol. % of a propylene oxide-added bisphenol derivative of the above-mentioned formula (I) (PO-BPA, x+y=2.2 (average)), 33 mol. % of ethylene oxide-added bisphenol derivative of the formula (I) (EO-BPA, x+y=3.2 (average)), and a small amount of organotin compound were charged and heated to 220° C. under nitrogen gas stream to complete dehydro-condensation polymerization, thereby obtaining first polyether resin.

On the other hand, 36 mol. % of terephthalic acid, 15 mol. % of trimellitic anhydride, 30 mol. % of PO-BPA (x+y=2.4), 19 mol. % of EO-BPA (x+y=2.8), and a small amount of organotin compound were subjected to dehydro-condensation polymerization similarly as above to obtain second polyester resin. Then, 60 wt. parts of the first polyester resin and 40 wt. parts of the second polyester resin were heat-melted and mixed under stirring, followed by cooling to obtain Binder Resin (2).

As a result of measurement, Binder Resin (2) showed $P_1MW=0.72\times10^4$, a shoulder at a molecular weight of ca. $6\times10^4$, $Mw=30\times10^4$, Mn=4,000, a THF-insoluble content= 15 wt. %, and Tg=58° C.

Separately, Waxes (A)–(B) respectively of low-molecular weight having properties shown in Table 1 appearing hereinafter were provided for use in Examples and Comparative Examples described hereinafter. Waxes (A)–(G) are generally characterized as follows.

Wax (A) comprises 80 wt. % of long chain-alkyl alcohol having averagely 50 carbon atoms and represented by a principal component of $CH_3(CH_2)_{46}CH_2OH$, and 20 wt. % of low-molecular weight polyethylene wax.

Wax (B) comprises 67 wt. % of long chain-alkyl alcohol having averagely 30 carbon atoms and represented by $CH_3(CH_2)_{26}CH_2OH$, and 33 wt. % of low-molecular weight polyethylene wax.

Wax (C) comprises 80 wt. % of long chain-alkyl carboxylic acid having averagely 50 carbon atoms and represented by $CH_3(CH_2)_{48}COOH$, and 20 wt. % of low-molecular weight polyethylene wax.

Wax (D) is substantially composed of long chain-alkyl alcohol having averagely 22 carbon atoms and represented by $CH_3(CH_2)_{16}CH_2OH$.

Wax (E) is a fractionation product from a hydrocarbon compound formed by low-pressure polymerization of ethylene in the presence of a Ziegler catalyst.

Wax (F) is a low-molecular weight polyethylene wax produced by thermal decomposition of polyethylene.

Wax (G) is a low-molecular weight polypropylene wax produced by thermal decomposition of polypropylene.

TABLE 1

| | DSC data | | | | GPC data | | |
|---|---|---|---|---|---|---|---|
| Wax | Max. absorption peak temp. $P_1P$ (°C.) | Max evolution peak temp. $P_2P$ (°C.) | Difference $\|P_1P - P_2P\|$ (°C.) | Absorption peak onset temp. S-OP (°C.) | Mw | Mn | Mw/Mn |
| (A) | 94 | 92 | 2 | 81 | 850 | 440 | 1.9 |
| (B) | 72 | 67 | 5 | 52 | 510 | 250 | 2.0 |
| (C) | 98 | 90 | 8 | 84 | 910 | 360 | 2.5 |
| (D) | 66 | 62 | 4 | 47 | 380 | 190 | 2.0 |
| (E) | 116 | 104 | 12 | 77 | 1900 | 510 | 3.7 |
| (F) | 128 | 112 | 16 | 109 | 3600 | 930 | 3.9 |
| (G) | 135 | 101 | 34 | 128 | 4300 | 980 | 4.4 |

EXAMPLE 1

| | |
|---|---|
| Binder Resin (1) | 100 wt. parts |
| Magnetic powder (average particle size (Dav) = 0.24 μm, BET specific surface area ($S_{BET}$) = 7 $m^2/g$, bulk-density ($D_B$) = 0.94 $g/cm^3$) | 90 wt. parts |
| Negative charge control agent (monoazo dye iron complex) | 2 wt. parts |
| Wax (A) | 8 wt. parts |

The above ingredients were sufficiently dry-blended in a Henschel mixer ("Model FM-75", made by Mitsui Miike Kakohki K.K.) and then melt-kneaded in a twin-screw extrusion kneader ("PCM-30" (remodeled), made by Ikegai Tekko K.K.). The melt-kneaded product was cold-stretched by a press roller equipped with a belt cooler and coarsely pulverized into a size of 1 mm or smaller by a hammer mill to obtain a pulverized feed material for toner production.

The pulverized feed material was introduced into an apparatus system as shown in FIG. 12 and finely pulverized and classified therein. A collision-type pneumatic pulverizer 108 had a structure as described with reference to FIGS. 6 and 7 including a cone-shaped collision surface 37 having an apex angle (θ) of 150 deg. By using a metering feeder 102 and an injection feeder 201, the pulverized feed material was supplied at a rate of 30 kg/hr to a spiral air stream classifier 109 ("Model DS-UR", mfd. by Nippon Pneumatic Kogyo K.K.) to recover a first coarse powder, which was pulverized by the pulverizer 108 using 6.0 $Nm^3$/min of compressed air at a pressure of 6.0 $kg/cm^2$ and then recycled to the first classifier 109.

A classified first fine powder from the first classifier 109 was introduced via second metering feeder 110 and an injection feeder 202 into a second classifier 220 ("Deeplex Ultrafine Powder Classifier 100 ATP", mfd. by Hosokawa Micron K.K.) having a classification point set to 2.9 μm, where the first fine powder was classified into a second fine powder and a second coarse powder.

The second fine powder was recovered by a collecting cyclone 203, and the second coarse powder was sent via an injection feeder 221 and a collecting cyclone 204 to a third metering feeder 210, and further sent via a vibration feeder 103, an injection feeder 147 and a nozzle 116 to a third multi-division classifier 101 ("Elbow Jet EJ-15-3", mfd. by Nittetsu Kogyo K.K.) utilizing the Coanda effect for classification into three fractions of a fine powder fraction (first fraction), a medium powder fraction (second fraction) and a coarse powder fraction (third fraction) and having a structure described with reference to FIGS. 9 and 10. The classification points were set to 4.1 μm between the first and second fractions and 8.5 μm between the second and third fractions. The introduction into the third multi-division classifier was effected by utilizing a suction force caused by a reduced pressure in the system generated by the operation of collecting cyclones 104, 105 and 106 connected through exhaust pipes 111, 112 and 113, and utilizing a compressed air supplied from the injection feeder 147 connected to the feed supply nozzle 116.

The classification of the second coarse powder was effected in an instant of 0.01 sec or shorter. The coarse powder fraction classified by the multi-division classifier 101 was recovered by the collecting cyclone 106 and re-introduced into the fine pulverizer 108. The medium powder fraction and the fine powder were recovered by the collecting cyclones 105 and 104, respectively. In the above, the classification point refers to a particle size corresponding to a partial classification efficiency of 50% (50%-classification diameter $D_{50}$ (μm)).

In the apparatus system, the transportation air speeds were all set to be at least 35 m/sec at the point immediately after the injection feeder 201, and at sections (A) to (D) in FIG. 1, more specifically at air speeds indicated in Table 2 at the respective points.

The classified medium powder fraction (i.e., a toner product containing isolated particles of the low-molecular weight wax) showed a weight-average particle size ($D_4$) of 6.4 μm, and a fine powder content (i.e., percentage of particles having a particle size of 4.01 μm based on a number-basis particle size distribution) of 22.5% by number. The particle size distribution values of toner products referred to herein are based on values measured by using a Coulter counter for taking a distribution of particles having sizes of 2 μm or larger.

100 wt. parts of the medium powder fraction and 1.4 wt. parts of hydrophobic silica fine powder ($S_{BET}$=200 $m^2/g$) were dry-blended in a Henschel mixer to prepare Toner (I).

As a result of measurement, Toner (I) showed $P_1MW$ of 6,000, $P_2MW$ of $75\times10^4$, Mw=$25\times10^4$, Mn=5100, Mw/Mn=49, areal percentages for a low-molecular weight component (molecular weight of at most 1000) and a high-molecular weight component (molecular weight of at least $100\times10^4$) of 5.4% and 9.5%, respectively, THF-insoluble content of 0 wt. %, and Tg=58° C.

The production conditions and properties of the toner are summarized in Tables 2 and 3 appearing hereinafter.

EXAMPLES 2–6 AND COMPARATIVE EXAMPLES 1–6

Toner (II)–(VI) and Comparative Toners (i)–(vi) were prepared from the prescription and under production conditions shown in Table 2 otherwise in a similar manner as in Example 1. The properties of the resultant toners are summarized in Table 3.

The number of isolated wax particles present in the toner (particles per 10,000 toner particles) was evaluated in the product toner and with respect to a sample powder taken at section (A) in the apparatus of FIG. 12 at a point of 60 hours during a continuous operation for 120 hours. The results are shown in Table 2.

Figure 13:
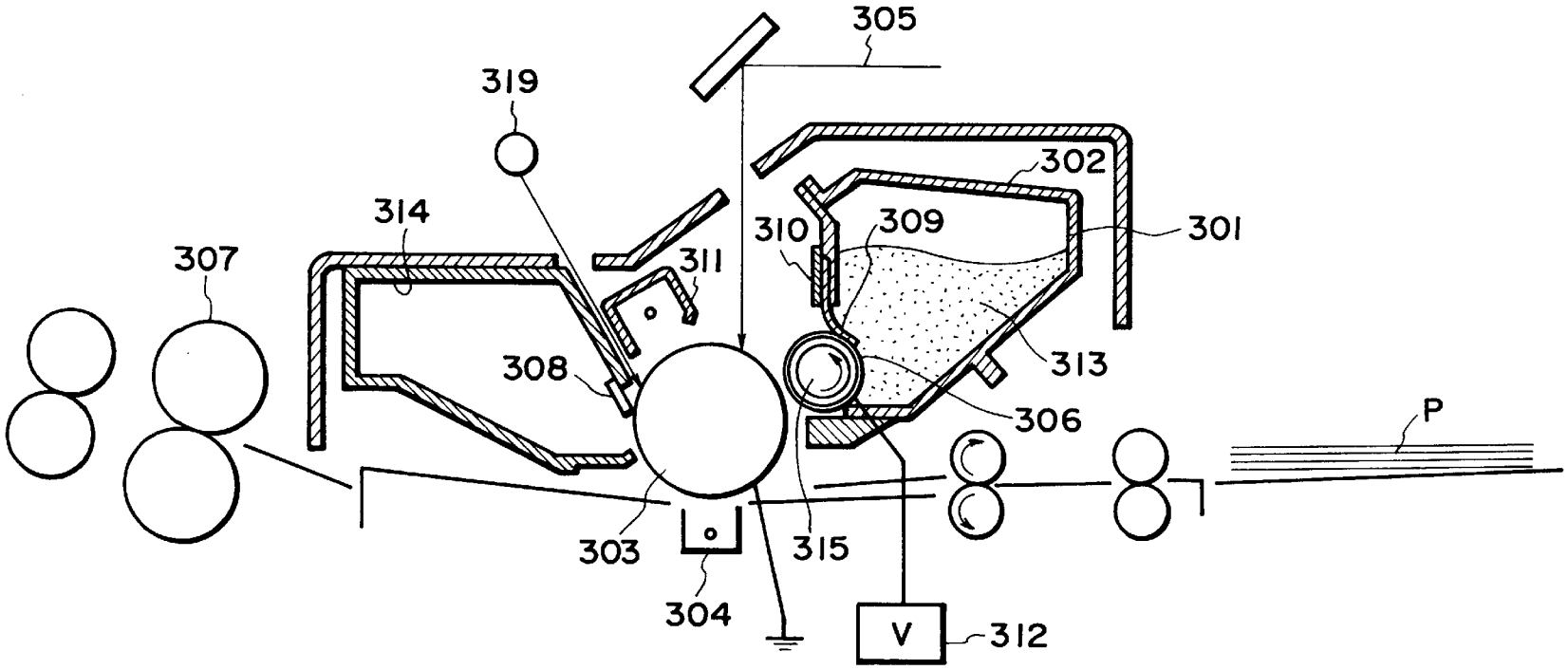
FIG. 13 is a sectional illustration of an image forming apparatus used for evaluation of a toner according to the invention.

After the preparation of the respective toners for a continuous operation of 120 hours, the inner wall states of the pipes at the sections (A)–(D) in the apparatus of FIG. 12 were checked by observation with eyes with respect to the powder attachment, melt-sticking and solidification. The observed melt-sticking states were evaluated according to the following standard and the results are shown in Table 2.

mfd. by Canon K.K.) were remodeled in the following manner to provide a printer as shown in FIG. 13.

The laser unit was remodeled to be suitable for providing a resolution of 600 dpi. The cartridge was re-modeled as shown in FIG. 13, so as to attach a urethane rubber-made elastic blade 309 abutted at a pressure of 30 g/cm against a developing sleeve 306.

For the image formation, an OPC photosensitive drum 303 was charged at a primary voltage of −600 volts for electrostatic image formation thereon. The spacing between the photosensitive drum 303 and the developing sleeve 306 (containing a magnet 315) was set at 300 $\mu$m so that the magnetic toner layer on the sleeve 306 did not contact the photosensitive drum 303. The developing sleeve was supplied with an AC bias voltage (f=1800 Hz, Vpp=1400 V) and a DC bias voltage ($V_D$=−450 V) in superposition. A heat-

TABLE 2

| | | | | Kneading conditions | | | | | Melt-sticking evaluation at section | | | | Isolated wax particles | |
|---|---|---|---|---|---|---|---|---|---|---|---|---|---|---|
| | Prescription | | | Melt viscosity | | Ln/L × 100 | Cooling | Toner | (A) 36 m/ | (B) 44 m/ | (C) 81 m/ | (D) 39 m/ | (1/10000) Section | |
| Example | Toner | Resin | Wax (wt. parts) | (poise) | L/D × W/R | (%) | speed | MI | sec | sec | sec | sec | (A) | Toner |
| Ex. 1 | (I) | (1) | (A) 8 | $1.5 \times 10^4$ | 7.5 | 20 | 15 | 29 | A | A | A | A | 28 | 18 |
| 2 | (II) | (1) | (B) 8 | $4.4 \times 10^3$ | 7.5 | 20 | 15 | 35 | A | A | B | A | 19 | 12 |
| 3 | (III) | (1) | (A) 4 (G) 4 | $7.0 \times 10^5$ | 7.5 | 20 | 15 | 12 | A | A | C | B | 35 | 24 |
| 4 | (IV) | (2) | (C) 8 | $3.0 \times 10^2$ | 10 | 15 | 10 | 46 | A | A | A | A | 32 | 20 |
| 5 | (V) | (2) | (C) 8 | $5.9 \times 10^3$ | 78 | 5 | 21 | 41 | B | A | A | B | 47 | 40 |
| 6 | (VI) | (2) | (C) 8 | $6.2 \times 10^4$ | 1.8 | 30 | 0.8 | 52 | B | C | C | B | 21 | 14 |
| Comp. Ex. 1 | (i) | (1) | (D) 8 | $3.1 \times 10^2$ | 7.5 | 20 | 15 | 44 | C | C | D | D | 9 | 5 |
| 2 | (ii) | (1) | (G) 8 | $8.2 \times 10^6$ | 1.8 | 4 | 25 | 7 | C | D | D | C | 270 | 240 |
| 3 | (iii) | (1) | (E) 8 | $3.7 \times 10^3$ | 110 | 45 | 10 | 42 | C | C | C | C | 120 | 110 |
| 4 | (iv) | (1) | (F) 8 | $5.1 \times 10^3$ | 110 | 65 | 0.4 | 35 | C | C | C | C | 550 | 530 |
| 5 | (v) | (2) | (E) 8 | $5.6 \times 10^2$ | 10 | 15 | 10 | 39 | C | B | B | B | 37 | 29 |
| 6 | (vi) | (2) | (F) 8 | $2.9 \times 10^3$ | 10 | 15 | 10 | 33 | C | C | D | C | 66 | 57 |

A: Very good. Not occurred at all.
B: Good. Substantially no sticking.
C: Fair. Sticking was observed but little affecting the production.
D: Poor. Remarkable sticking and problematic for the production.

TABLE 3

| | | | | | | Resin component (%) | | THF insoluble | Tg |
|---|---|---|---|---|---|---|---|---|---|
| Toner | $P_1Mw$ | $P_2Mw \times 10^4$ | $Mw \times 10^4$ | Mn | Mw/Mn | ≦1,000 | ≧100 × $10^4$ | (wt. %) | (°C.) |
| (I) | 6000 | 75 | 25 | 5100 | 49 | 5.4 | 9.5 | 0 | 58 |
| (II) | 6000 | 82 | 31 | 5300 | 58 | 5.2 | 12.2 | 0.4 | 56 |
| (III) | 6000 | 67 | 22 | 5000 | 44 | 6.6 | 6.4 | 0 | 58 |
| (IV) | 7300 | 59 | 25 | 4500 | 56 | 6.2 | 8.7 | 1.1 | 59 |
| (V) | 7300 | 60 | 28 | 5200 | 54 | 6.5 | 9.0 | 1.6 | 59 |
| (VI) | 7300 | 54 | 21 | 4200 | 50 | 6.4 | 8.2 | 2.8 | 59 |
| (i) | 6000 | 77 | 27 | 5200 | 52 | 5.7 | 10.8 | 0.3 | 56 |
| (ii) | 6000 | 61 | 19 | 4900 | 39 | 6.0 | 4.1 | 0 | 59 |
| (iii) | 6000 | 33 | 15 | 4200 | 36 | 15.5 | 0.4 | 0 | 57 |
| (iv) | 6000 | 30 | 12 | 4000 | 30 | 18.0 | 0.3 | 0 | 58 |
| (v) | 7400 | 48 | 18 | 4200 | 43 | 5.7 | 6.0 | 0.7 | 57 |
| (vi) | 7500 | 30 | 15 | 4300 | 35 | 5.3 | 7.5 | 6.5 | 58 |

Toner Performance Evaluation

Toners (I)–(VI) and Comparative Toners (i)–(iv) prepared above were respectively evaluated by image formation in the following manner.

A commercially available laser beam printer ("LBP-SX", mfd. by Canon K.K.) and a printer cartridge (for "LBP-8II"

pressure fixing device 307 was regulated at a process speed of 36 mm/sec, and the fixing device temperature was set to 130° C.

Under the above-set conditions, a continuous print-out test on 5,000 A4-sheets was performed at a printing speed of 5 A4-sheets/min. in a normal temperature/normal humidity environment (25° C./60%RH). The resultant images were evaluated with respect to the following items. Each toner was further evaluated with respect to anti-blocking property. Further, the matching with the printer of each toner was evaluated in a manner described below. The results are shown in Table 4 and 5.

Printed-out image evaluation (Table 4)

(1) Image density

The density of an image formed on an ordinary plain paper for copying machine (75 g/m$^2$) after printing 3000 sheets was evaluated by a Macbeth Reflection Densitometer (available from Macbeth Co.) as a relative density against a density of 0.00 allotted to a printed white background portion, and the results are evaluated according to the following standards.

A (excellent): 1.40 or above

B (good): at least 1.35 and below 1.40

C (fair): at least 1.00 and below 1.35

D (not acceptable): below 1.00

(2) Dot reproducibility

Figure 14:
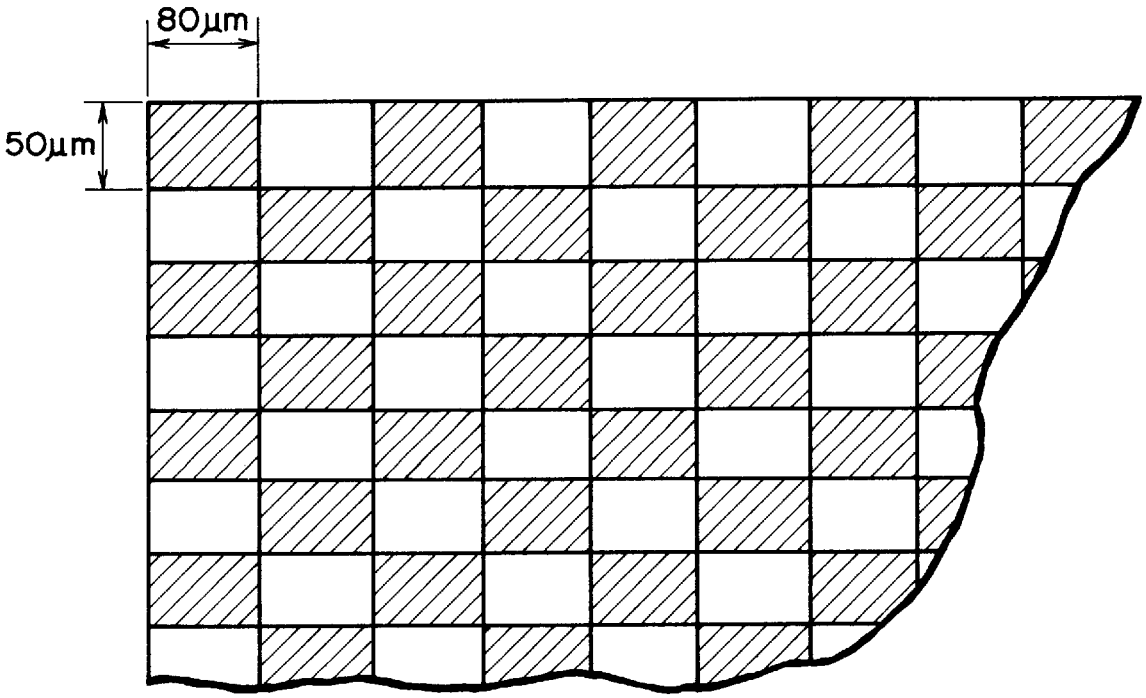
FIG. 14 is an illustration of a checker pattern used for evaluating the developing performance of a toner.

A checker pattern shown in FIG. 14 was printed out and the dot reproducibility was evaluated by counting the number of lacked dots. The results were evaluated according to the following standards:

A (very good): lack of 2 dots or less/100 dots

B (good): lack of 3–5 dots/100 dots

C (practically acceptable): lack of 6–10 dots/100 dots

D (practically unacceptable): lack of 11 dots or more/100 dots (3) Image fog

Image fog (%) was evaluated as a difference between the whiteness of a white background portion of a printed image and the whiteness of an original transfer paper by measurement with "Reflectometer" (available from Tokyo Denshoku K.K.). The results are indicated according to the following standards:

A (very good): below 1.5%

B (good): at least 1.5% and below 2.5%

C (practically acceptable): at least 2.5% and below 4.0%

D (practically unacceptable): at least 4%

(4) Fixability

A fixed image was rubbed two times (one reciprocation) with a soft tissue paper under a load of 50 g/cm$^2$, and the fixability was evaluated by a lowering (%) in image density after the rubbing. The results were evaluated according to the following standards.

A (excellent): 5% or below

B (good): at least 5% and below 10%

C (fair): at least 10% and below 20%

D (not acceptable): at least 20%

(5) Anti-offset characteristic

A sample image having an image percentage of about 5% was printed out, and the anti-offset characteristic was evaluated by the degree of s soiling on the image after printing of 3000 sheets. The results were evaluated by the following standards.

A: Very good (non-observable)

B: Good (substantially non-observable)

C: Practically acceptable

D: Practically unacceptable

Anti-blocking property

Ca. 10 g of each toner sample was placed in a 100-cc plastic cup, and left standing at 50° C. for 3 days. The state of the toner after the standing was evaluated at four levels.

A (very good): No change.

B (good): Agglomerate was observed but readily disintegrated.

C (fair): Disintegration of agglomerate was possible but not easy.

D (poor): Caking occurred.

Evaluation of matching with image forming apparatus (Table 5)

(1) Matching with developing sleeve

After the printing test, the state of residual toner sticking onto the developing sleeve surface and the influence thereof on the printed images were evaluated by observation with eyes. The results were evaluated according to the following standards.

A: Very good (not observable)

B: Good (substantially non-observable)

C: Fair (sticking was observed but did not affect the images)

D: Poor (much sticking was observed and resultant in image irregularity)

(2) Matching with OPC photosensitive drum

Similarly, the occurrence of scars and residual toner on the photosensitive drum surface and the influence thereof on the printed images were evaluated by observation with eyes.

A: Very good (non-observable)

B: Good (the occurrence of slight scar was observable but did not affect the images)

C: Fair (sticking and scars were observed but little affected the images)

D: Poor (much sticking was observed and caused streak-like image irregularity)

TABLE 4

| | | Printed image evaluation | | | | | |
|---|---|---|---|---|---|---|---|
| Example | Toner | Image density | Dot reproducibility | Image fog | Fixability | Anti-offset | Anti-blocking |
| Ex. 1 | (I) | A | A | A | A | A | A |
| 2 | (II) | A | A | A | A | B | B |
| 3 | (III) | A | A | A | A | A | A |
| 4 | (IV) | A | A | A | A | A | A |
| 5 | (V) | A | B | C | A | B | B |
| 6 | (VI) | B | C | B | B | A | A |
| Comp. Ex. 1 | (i) | B | C | C | C | C | D |

TABLE 4-continued

| Example | Toner | Printed image evaluation | | | | | |
|---|---|---|---|---|---|---|---|
| | | Image density | Dot reproducibility | Image fog | Fixability | Anti-offset | Anti-blocking |
| 2 | (ii) | C | D | C | D | C | D |
| 3 | (iii) | C | D | D | C | C | D |
| 4 | (iv) | D | D | D | D | C | D |
| 5 | (v) | B | B | C | C | C | B |
| 6 | (vi) | B | C | D | D | C | C |

TABLE 5

| Example | Matching with image forming apparatus | |
|---|---|---|
| | Developing sleeve | OPC photosensitive drum |
| Ex. 1 | A | A |
| Ex. 2 | A | A |
| Ex. 3 | A | A |
| Ex. 4 | A | A |
| Ex. 5 | B | A |
| Ex. 6 | A | B |
| Comp. Ex. | | |
| 1 | C | D |
| 2 | C | C |
| 3 | D | D |
| 4 | D | D |
| 5 | B | C |
| 6 | C | D |

What is claimed is:

1. A toner for developing electrostatic images comprising: 100 parts by weight of a binder resin, a colorant and 1 to 20 parts by weight of a low molecular weight wax having a weight average molecular weight (Mw) of at most 30,000, said binder resin, said colorant and a portion of said low molecular weight wax present as toner particles and the balance of the low-molecular weight wax present as wax particles;

wherein the toner has a melt index as measured at 125° C. under a load of 98 N of at least 10 g/10 min, the wax particles are present at a ratio of 10–500 wax particles per 10,000 toner particles, the low-molecular weight wax comprises a compound represented by the formula of: R—Y, wherein R denotes a hydrocarbon group, and Y denotes a hydroxyl group, carboxyl group, alkyl ether group or alkyl ester group; and the low-molecular weight wax has a thermal property providing a DSC curve as measured by a differential scanning calorimeter exhibiting:

(i) a maximum heat-absorption peak on temperature increase having a peak temperature in a temperature range of 70°–130° C.;

(ii) a heat-absorption peak including the maximum heat-absorption peak showing an onset temperature of at least 50° C., and (iii) a maximum heat-evolution peak on temperature decrease in a range of ±15° C. from the peak temperature of the maximum heat absorption peak.

2. The toner according to claim 1, wherein the wax particles are present at a rate of 10–100 particles per 10,000 toner particle.

3. The toner according to claim 1, wherein the low-molecular weight wax has an Mw of at most 10,000.

4. The toner according to claim 1, wherein the low-molecular weight wax has an Mw of 400–3,000.

5. The toner according to claim 4, wherein the low-molecular weight wax has a number-average molecular weight (Mn) of 200–2,000, and an Mw/Mn ratio of at most 3.0.

6. The toner according to claim 1, wherein the low-molecular weight wax contains at least 60% of a long-chain alkyl compound represented by the formula R'—Y, wherein R' denotes a long-chain alkyl group having 20–202 carbon atoms, and Y denotes a hydroxyl group, carboxyl group, alkyl ether group or alkyl ester group.

7. The toner according to claim 6, wherein the low-molecular weiaht wax contains at least 70 wt. % of the long-chain alkyl compound.

8. The toner according to claim 1, wherein the low-molecular weight wax contains at least 60 wt. % of long-chain alkyl alcohol of formula $CH_3(CH_2)_nCH_2OH$, wherein n is a number of 20–200.

9. The toner according to claim 8, wherein the low-molecular weight wax contains at least 70 wt. % of the long-chain alkyl alcohol.

10. The toner according to claim 1, wherein the low-molecular weight wax contains at least 60 wt. % of long-chain alkyl carboxylic acid of formula $CH_3(CH_2)_n CH_2COOH$, wherein n is a number of 20–200.

11. The toner according to claim 10, wherein the low-molecular weight wax contains at least 70 wt. % of the long-chain alkyl carboxylic acid.

12. The toner according to claim 1, wherein the binder resin contains a tetrahydrofuran (THF)-soluble content providing a gel permeation chromatography (GPC) molecular weight distribution showing a main peak in a molecular weight range of 2,000 to 30,000 and a sub-peak or shoulder in a molecular weight range exceeding $10^5$.

13. The toner according to claim 12, wherein the binder resin contains substantially no THF-insoluble content, and the THF-soluble content of the binder resin provides a GPC molecular weight distribution showing a weight-average molecular weight (Mw) and a number-average molecular weight (Mn) giving a ratio Mw/Mn of at least 20, an areal percentage of at most 15% of a low-molecular weight component having a molecular weight of at most 1000, and an areal percentage of 0.5–25% of a high-molecular weight component having a molecular weight of at least $10^6$.

14. The toner according to claim 1, wherein the colorant comprises magnetic particles having a bulk density of at least 0.35 g/cm$^3$.

15. The toner according to claim 1, wherein the low-molecular weight wax is present in a proportion of 2–15 wt. parts per 100 wt. parts of the binder resin.

16. A process for producing a toner, comprising:

a preliminary blending step of blending a feed material of a toner composition including at least 100 parts by weight of a binder resin, a colorant and 1 to 20 parts by weight of a low-molecular weight wax having a weight average molecular weight ($M_w$) of at most 30,000 by means of a blender to prepare a blend, a melt-kneading step of melt-kneading the blend by a kneading means to form a kneaded product, a pulverization step of pulverizing the kneaded product after cooling by a pulverizing means to form a pulverizate, and a classification step of classifying the pulverizate by a classifying means to recover a toner;

wherein the classification step includes a powder transporting step using an air injection feeder;

wherein the toner has a melt index as measured at 125° C. under a load of 98N of at least 10 g/10 min, the wax particles are present at a ratio of 10–500 wax particles per 10,000 toner particles, the low-molecular weight wax comprises a compound represented by the formula of: R—Y, wherein R denotes a hydrocarbon group, and Y denotes a hydroxyl group, carboxyl group, alkyl ether group or alkyl ester group; and the low-molecular weight was has a thermal property providing a DSC curve as measured by a differential scanning calorimeter exhibiting:

(i) a maximum heat-absorption peak on temperature increase having a peak temperature in a temperature range of 70°–130° C., (ii) a heat-absorption peak including the maximum heat-absorption peak showing an onset temperature of at least 50° C., and (iii) a maximum heat-evolution peak on temperature decrease in a range of ±15° C. from the peak temperature of the maximum heat-absorption peak.

17. The process according to claim 16, wherein the pulverizate is conveyed along with high-speed air at a speed of at least 35 m/sec by the air injection feeder.

18. The process according to claim 16, wherein the blend was melt-kneaded at melt-viscosity of $10^2$14 $10^6$ poise under heating, and then cooled at a rate of 1°–20° C./sec.

19. The process according to claim 16, wherein the kneading means comprise an extrusion kneader having a paddle total length L (cm), a screw diameter D (cm), a throughput W (kg/hr), and a paddle rotation speed R (rpm) set to satisfy the following formula:

$$2 \leqq (L/D) \times (W/R) \leqq 100.$$

20. The process according to claim 19, wherein the extrusion kneader has at least two kneading sections giving a total length Ln along the paddle total length L satisfying Ln/L=5–30%.

21. The process according to claim 16, wherein the pulverizing means comprises a jet pneumatic pulverizer or a mechanical collision pulverizer.

22. The process according to claim 21, wherein the jet pneumatic pulverizer comprises a pulverization chamber and a collision member disposed therein, the collision member having a collision surface forming a cone having an apex angle of 110–175 deg.

23. The process according to claim 16, wherein the classifying means comprises a spiral air stream classifier wherein an air stream introduced from outside forms a whirling stream to effect classification.

24. The process according to claim 16, wherein the classifying means comprises a multi-division classifier utilizing the Coanda effect.

25. The process according to claim 16, wherein three classifying means are used in the classification step.

26. The process according to claim 16, wherein the pulverizate was further pulverized to provide a fine pulverizate wherein 10–500 wax particles are present per 10,000 particles of the toner composition.

27. The process according to claim 26, wherein the fine pulverizate contains 10–100 wax particles per 10,000 particles of the toner composition.

28. The process according to claim 16, wherein the low-molecular weight wax has an Mw of at most 10,000.

29. The process according to claim 16, wherein the low-molecular weight wax has an Mw of 400–3,000.

30. The process according to claim 29, wherein the low-molecular weight wax has a number-average molecular weight (Mn) of 200–2,000, and an Mw/Mn ratio of at most 3.0.

31. The process according to claim 16, wherein the low-molecular weight wax contains at least 60% of a long-chain alkyl compound represented by the formula R'—Y, wherein R' denotes a long-chain alkyl group having 20–202 carbon atoms, and Y denotes a hydroxyl group, carboxyl group, alkyl ether group or alkyl ester group.

32. The process according to claim 31, wherein the low-molecular weight wax contains at least 70 wt. % of the long-chain alkyl compound.

33. The process according to claim 16, wherein the low-molecular weight wax contains at least 60 wt. % of long-chain alkyl alcohol of formula $CH_3(CH_2)_nCH_2OH$, wherein n is a number of 20–200.

34. The process according to claim 33, wherein the low-molecular weight wax contains at least 70 wt. % of the long-chain alkyl alcohol.

35. The process according to claim 16, wherein the low-molecular weight wax contains at least 60 wt. % of long-chain alkyl carboxylic acid of formula $CH_3(CH_2)_nCH_2COOH$, wherein n is a number of 20–200.

36. The process according to claim 35, wherein the low-molecular weight wax contains at least 70 wt. % of the long-chain alkyl carboxylic acid.

37. The process according to claim 16, wherein the binder resin contains a tetrahydrofuran (THF)-soluble content providing a gel permeation chromatography (GPC) molecular weight distribution showing a main peak in a molecular weight range of 2,000 to 30,000 and a sub-peak or shoulder in a molecular weight range exceeding $10^5$.

38. The process according to claim 37, wherein the binder resin contains substantially no THF-insoluble content, and the THF-soluble content of the binder resin provides a GPC molecular weight distribution showing a weight-average molecular weight (Mw) and a number-average molecular weight (Mn) giving a ratio Mw/Mn of at least 20, an areal percentage of at most 15% of a low-molecular weight component having a molecular weight of at most 1000, and an areal percentage of 0.5–25% of a high-molecular weight component having a molecular weight of at least $10^6$.

39. The process according to claim 16, wherein the colorant comprises magnetic particles having a bulk density of at least 0.35 g/cm$^3$.

* * * * *

UNITED STATES PATENT AND TRADEMARK OFFICE

CERTIFICATE OF CORRECTION

PATENT NO. : 5,840,459

DATED : November 24, 1998

INVENTOR(S) : MANABU OHNO ET AL.

It is certified that error appears in the above-identified patent and that said Letters Patent is hereby corrected as shown below:

On title page,

[56] REFERENCES CITED

U.S. Patent Documents
"Tamono et al." (both occurrences) should read --Tomono et al.--.

Foreign Patent Documents
Insert: --57-52574 11/82 Japan--.
Insert: --3-26831 4/91 Japan--.
"52-3304 1/1997" should read --52-3304 1/1977--.

[57] ABSTRACT

Line 18, "hat-" should read --heat---.

COLUMN 1

Line 28, "above mentioned" should read --above-mentioned--.

COLUMN 3

Line 46, "mechanism" should read --mechanical--.

COLUMN 4

Line 3, "meltkneading-pulverization" should read --melt-kneading-pulverization--.

UNITED STATES PATENT AND TRADEMARK OFFICE

CERTIFICATE OF CORRECTION

PATENT NO. : 5,840,459

DATED : November 24, 1998

INVENTOR(S) : MANABU OHNO ET AL.

It is certified that error appears in the above-identified patent and that said Letters Patent is hereby corrected as shown below:

COLUMN 5

Line 37, "50°0C.," should read --50°C.--.
Line 40, "hat-absorption" should read --heat-absorption--.

COLUMN 6

Line 8, "view" should read --view of--.
Line 38, "meltkneading-" should read --melt-kneading---.
Line 45, "characterized" should read --characterized by--.

COLUMN 7

Line 12, "meltkneading-pulverization" should read --melt-kneading-pulverization--.

COLUMN 8

Line 38, "Melt index" should read -- Melt Index--.

COLUMN 10

Line 49, "combination" should read --combination with--.

UNITED STATES PATENT AND TRADEMARK OFFICE

CERTIFICATE OF CORRECTION

PATENT NO. : 5,840,459 Page 3 of 5

DATED : November 24, 1998

INVENTOR(S) : MANABU OHNO ET AL.

It is certified that error appears in the above-identified patent and that said Letters Patent is hereby corrected as shown below:

COLUMN 13

Line 2, " $-CH_2-\overset{\overset{\displaystyle CH_3}{|}}{CH}-$ or $-CH_2-\overset{\overset{\displaystyle CH_3}{|}}{\underset{\underset{\displaystyle CH_3}{|}}{C}}-$. " should be deleted.

Line 12, "$-CH_2CH_2-$," should read

--$CH_2CH_2$, $-CH_2-\overset{\overset{\displaystyle CH_3}{|}}{CH}-$ or $-CH_2-\overset{\overset{\displaystyle CH_3}{|}}{\underset{\underset{\displaystyle CH_3}{|}}{C}}-$. --.

Line 18, "$C_6$-$C_8$" should read --$C_6$-$C_{18}$--.

COLUMN 14

Line 66, "weiaht" should read --weight--.

COLUMN 15

Line 14, "($\leq 10^6$)" should read --($\geq 10^6$)--.

COLUMN 16

Line 34, "above described" should read --above-described--.

UNITED STATES PATENT AND TRADEMARK OFFICE

CERTIFICATE OF CORRECTION

PATENT NO. : 5,840,459

DATED : November 24, 1998

INVENTOR(S) : MANABU OHNO ET AL.

It is certified that error appears in the above-identified patent and that said Letters Patent is hereby corrected as shown below:

COLUMN 17

Line 39, "melt-stickina" should read --melt-sticking--.

COLUMN 27

Line 2, "meltkneading" should read --melt-kneading--.
Line 28, "meltkneading" should read --melt-kneading--.
Line 51, "meltkneading-pulverization" should read --melt-kneading-pulverization--.

COLUMN 29

Line 21, "let" should read --jet--.

COLUMN 30

Line 1, "weiaht" should read --weight--.

UNITED STATES PATENT AND TRADEMARK OFFICE

CERTIFICATE OF CORRECTION

PATENT NO. : 5,840,459 Page 5 of 5

DATED : November 24, 1998

INVENTOR(S) : MANABU OHNO ET AL.

It is certified that error appears in the above-identified patent and that said Letters Patent is hereby corrected as shown below:

COLUMN 34

Line 7, "Measurement," should read --measurement,--.

Signed and Sealed this

Second Day of November, 1999

*Attest:*

Q. TODD DICKINSON

*Attesting Officer*

*Acting Commissioner of Patents and Trademarks*